US009891561B2

(12) United States Patent
Shibuya

(10) Patent No.: US 9,891,561 B2
(45) Date of Patent: Feb. 13, 2018

(54) IMAGE FORMING DEVICE AND METHOD OF ACQUIRING PHOTORECEPTOR LAYER THICKNESS

(71) Applicant: Konica Minolta, Inc., Tokyo (JP)

(72) Inventor: Satoru Shibuya, Chiryu (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/420,624

(22) Filed: Jan. 31, 2017

(65) Prior Publication Data

US 2017/0227895 A1 Aug. 10, 2017

(30) Foreign Application Priority Data

Feb. 4, 2016 (JP) ..... 2016-019888

(51) Int. Cl.
*G03G 15/00* (2006.01)
*G03G 15/16* (2006.01)

(52) U.S. Cl.
CPC ..... *G03G 15/1665* (2013.01)

(58) Field of Classification Search
CPC ..... G03G 15/75
USPC ..... 399/26
See application file for complete search history.

(56) References Cited

U.S. PATENT DOCUMENTS 7,747,184 B2 * 6/2010 DiRubio et al. ..... G03G 15/553 399/26
8,559,832 B2 * 10/2013 Burry et al. ..... G03G 15/75 399/26

FOREIGN PATENT DOCUMENTS

| | | | |
|---|---|---|---|
| JP | H08220935 | A | 8/1996 |
| JP | H08292666 | A | 11/1996 |
| JP | 2000010364 | A | 1/2000 |
| JP | 2006154006 | A | 6/2006 |

* cited by examiner

*Primary Examiner* — William J Royer
(74) *Attorney, Agent, or Firm* — Lucas & Mercanti, LLP

(57) ABSTRACT

An image forming device that forms an image by transferring a toner image formed by developing an electrostatic latent image formed on a photoreceptor from the photoreceptor to an intermediate transfer body by applying a transfer bias to a transfer member and putting the transfer member in contact with the intermediate transfer body. The device includes: a current supplier selectively supplying a first constant current and a second constant current to the transfer member; a first voltage acquirer acquiring a first voltage occurring between the transfer member and the intermediate transfer body while the transfer member is supplied with the first constant current; a second voltage acquirer acquiring a second voltage occurring between the transfer member and the photoreceptor while the transfer member is supplied with the second constant current; and a thickness acquirer acquiring a value indicating photoreceptor layer thickness of the photoreceptor by using the first and second voltages.

11 Claims, 13 Drawing Sheets

IMAGE FORMING DEVICE AND METHOD OF ACQUIRING PHOTORECEPTOR LAYER THICKNESS

This application is based and claims the priority of Japanese Patent Application No. 2016-019888 filed on Feb. 4, 2016 in Japan, the contents of which is hereby incorporated by reference.

BACKGROUND

(1) Technical Field

The present invention is related to image forming devices that form an image by transferring a toner image formed on a photoreceptor to an intermediate transfer member. In particular, the present invention is related to a technology of acquiring a thickness of a photoreceptor layer.

(2) Description of Related Art

In an image forming device having an electronic photograph system, such as a copier or a printer, a charger electrically charges a circumferential surface of a photoreceptor drum so that all areas of the circumferential surface have the same electric potential, and the circumferential surface, after being electrically charged, is exposed to light, whereby an electrostatic latent image is formed on the circumferential surface. Subsequently, toner is supplied from a developer to the circumferential surface to make this electrostatic latent image visible, whereby a toner image is formed on the circumferential surface of the photoreceptor drum.

Photoreceptor drum lifetime is greatly dependent upon the thickness of a photoreceptor layer of the photoreceptor drum (referred to in the following as photoreceptor layer thickness). Specifically, when photoreceptor layer thickness decreases due to abrasion and becomes equal to or smaller than a predetermined thickness, noise appears in printed images and thus replacement of the photoreceptor drum becomes necessary.

The amount of abrasion-caused decrease in photoreceptor layer thickness is dependent upon (i) how strong a cleaning blade presses against the photoreceptor drum and (ii) toner coverage of print-target images. In the present disclosure, toner coverage of a print-target image is defined as a proportion of a surface area of a recording sheet area covered with toner, and thus, is indicative of the amount of toner used to print the print-target image. For example, when printing a solid black image onto an A4 size recording sheet, the toner coverage for black toner is 100%. Specifically, the higher the toner coverage of a print-target image, the greater the amount of abrasion-caused decrease in photoreceptor layer thickness. This is since the higher the toner coverage of a print-target image, the greater the amount of toner additive(s) remaining on a photoreceptor drum.

In view of this, a determination that the end of the lifetime of a photoreceptor drum has arrived is typically made when the total number of rotations of the photoreceptor drum has reached a predetermined threshold set based on standard usage conditions in the target market including standard toner coverage.

Meanwhile, corona chargers have been conventionally used as chargers for charging photoreceptor drums. A corona charger electrically charges a photoreceptor drum without coming in direct contact with the photoreceptor drum. If a corona charger is used for electrically charging a photoreceptor drum, the determination of whether or not the end of the lifetime of the photoreceptor drum has arrived can be made with a certain level of accuracy based on the total number of rotations of the photoreceptor drum as described above. This is because with a corona charger, the actual amount of abrasion-caused decrease in photoreceptor layer thickness does not differ by much from an expected amount of abrasion-caused decrease in photoreceptor layer thickness set based on standard toner coverage even if the actual toner coverage is higher or lower than the standard toner coverage, due to the corona charger not coming in direct contact with the photoreceptor drum.

In the meantime, there has been an active shift from corona chargers to charge rollers in the electronic photograph industry. This shift is taking place because charge rollers achieve a reduction in the amount of ozone generated and thereby improve environmental performance. However, differing from corona chargers, a charger roller electrically charges a photoreceptor drum by coming in direct contact with photoreceptor drum. Due to this, the amount of abrasion-caused decrease in photoreceptor layer thickness tends to be greater with charge rollers than with corona chargers.

Further, the amount of abrasion-caused decrease in photoreceptor layer thickness becomes more dependent upon toner coverage when using a charge roller than when using a corona charger, for the two reasons described in the following.

(a) A charge roller directly rubs toner additive(s) remaining on a photoreceptor drum against a photoreceptor drum. Thus, the amount of abrasion-caused decrease in photoreceptor layer thickness when toner coverage is high is greater when using a charge roller than when using a corona charger.

(b) When a charge roller discharges, discharge by-products tend to remain near the portion of the charge roller coming into contact with another member. Thus, with a charge roller, discharge by-products are likely to attach to a photoreceptor drum. In view of this, there is a conventional technology of scraping off the discharge by-products from the photoreceptor drum along with the photoreceptor layer. However, in order to achieve this, it is necessary to use a photoreceptor layer more easily removable by scraping than a photoreceptor layer used with a corona charger. Using such a photoreceptor layer results in an increase in the amount of abrasion-caused decrease of photoreceptor layer thickness, and thus increases the dependency on toner coverage to a further extent.

In connection with the above, FIG. 15 illustrates, for each of a case where a corona charger is used for photoreceptor drum charging and a case where a charge roller is used for photoreceptor drum charging, a relationship between toner coverage of print-target images and the amount of abrasion-caused decrease of the photoreceptor layer after a same number of sheets have been printed.

As illustrated in FIG. 15, with a corona charger, photoreceptor layer thickness does not decrease by much as toner coverage increases. This is because with a corona charger, the decrease in photoreceptor layer thickness occurs solely due to the abrasion brought about by a cleaning blade. However, with a charge roller, photoreceptor layer thickness decreases considerably as toner coverage increases, due to friction between the charge roller and the photoreceptor drum.

FIG. 16 illustrates, for each of a case where a corona charger is used and a case where a charge roller is used, (i) a difference between photoreceptor drum lifetime for standard toner coverage (referred to in the following as standard photoreceptor drum lifetime) and actual photoreceptor drum lifetime for high toner coverage and (ii) a difference between photoreceptor drum lifetime for standard toner coverage and actual photoreceptor drum lifetime for low toner coverage. Here, photoreceptor drum lifetime is defined as the amount of time after which the amount of abrasion-caused decrease of the photoreceptor layer thickness reaches a maximum permissible amount. Further, the standard toner coverage is set to approximately 10%, which is the toner coverage when normal text images are printed. Finally, the high toner coverage is set to a value (for example 70%) higher than the standard toner coverage by a predetermined amount, and the low toner coverage is set to a value (for example 5%) lower than the standard toner coverage by a predetermined amount.

As illustrated in FIG. 16, the photoreceptor drum lifetime for low toner coverage does not differ by much from the standard photoreceptor drum lifetime (dashed-dotted line). This applies to both the case where a corona charger is used (broken line) and the case where a charge roller is used (solid line). Meanwhile, with a corona charger, the photoreceptor drum lifetime for high toner coverage does not differ much from the standard photoreceptor drum lifetime. However, with a charge roller, the photoreceptor drum lifetime for high toner coverage is much shorter than the standard photoreceptor drum lifetime, which means that a great amount of abrasion-caused decrease of photoreceptor layer thickness occurs when a charge roller is used and toner coverage is high.

That is, the fluctuation from the standard photoreceptor drum lifetime, occurring when the toner coverage differs from the standard toner coverage, is considerably greater with a charge roller than with a corona charger.

As can be seen from this, and because images of different toner coverage are actually printed, determining the end of the photoreceptor drum lifetime based on the number of rotations of the photoreceptor drum is not practical, particularly when charge rollers are used.

As alternative methods for determining photoreceptor drum lifetime, the following methods can be considered, for example. One method is directly measuring the actual photoreceptor layer thickness by using a laser distance measurement device. Another method is determining photoreceptor drum lifetime by using a surface potential measurement device and measuring a decrease in electric potential of a photoreceptor drum surface that occurs when the photoreceptor layer thickness decreases and charge characteristics of the photoreceptor drum is impaired. However, such devices are of high cost, and in particular, providing such measurement devices for each photoreceptor drum in an image forming device having the tandem system, which typically has a plurality of photoreceptor drums, would inevitably result in a great increase in cost.

In view of such problems, Japanese Patent Application Publication No.: 2000-10364 (referred to in the following as Patent Literature), for example, discloses a method of acquiring photoreceptor layer thickness of a photoreceptor drum by (i) applying only an alternating voltage to a charge roller for the photoreceptor drum to remove static of the photoreceptor drum surface and provide the photoreceptor drum surface with a 0V electric potential, (ii) applying a constant direct current to a transfer roller and detecting the amount of current flowing through the transfer roller, and (iii) acquiring photoreceptor layer thickness based on a graph prepared beforehand that indicates the relationship between transfer roller current amount and photoreceptor layer thickness (refer to abstract, paragraph [0020], and FIG. 2 of Patent Literature).

However, the technology disclosed in Patent Literature is problematic for performing the acquisition of photoreceptor layer thickness without any consideration of a change in transfer roller resistance that occurs over time. Thus, with the technology disclosed in Patent Literature, there is a risk of the photoreceptor layer thickness acquired not being accurate.

In particular, it should be noted that many recent transfer rollers are made using ionic conductive rubber as conductive elastic material. Typically, a transfer roller made using ionic conductive rubber is characterized for its resistance being influenced to a considerable extent by surrounding conditions such as temperature and humidity, and for its resistance typically increasing after continuous application of current due to uneven ion distribution being formed therein.

Further, the level of increase of such transfer roller resistance differs greatly depending upon usage conditions (e.g., whether printing is performed continuously or intermittently). As such, the method such as that disclosed in Patent Literature of performing the acquisition of photoreceptor layer thickness while assuming that transfer roller resistance does not change leads to a great difference between the photoreceptor layer thickness acquired and the actual photoreceptor layer thickness.

SUMMARY

The present invention has been conceived taking such circumstances into account. Specifically, the present invention aims to provide an image forming device and a method of acquiring photoreceptor layer thickness that improve the accuracy of detection of photoreceptor layer thickness performed by applying a bias to a transfer member such as a transfer roller.

In order to achieve the above-described aim, one aspect of the technology pertaining to the present invention is preferably an image forming device including: a photoreceptor; a transfer member; and an intermediate transfer body, and forming an image by transferring a toner image formed by developing an electrostatic latent image formed on the photoreceptor from the photoreceptor to the intermediate transfer body by applying a transfer bias to the transfer member and putting the transfer member in contact with the intermediate transfer body, the image forming device including: a constant current supplier selectively supplying a first constant current and a second constant current to the transfer member; a first voltage acquirer acquiring a first voltage being a voltage occurring between the transfer member and the intermediate transfer body while the transfer member is being supplied with the first constant current; a second voltage acquirer acquiring a second voltage being a voltage occurring between the transfer member and the photoreceptor while the transfer member is being supplied with the second constant current; and a photoreceptor thickness acquirer acquiring a value indicating a thickness of a photoreceptor layer of the photoreceptor by using the first voltage and the second voltage.

Further, in order to achieve the above-described aim, another aspect of the technology pertaining to the present invention is preferably a method of acquiring a thickness of a photoreceptor layer of a photoreceptor in an image forming device including: the photoreceptor; a transfer member; and an intermediate transfer body, and forming an image by transferring a toner image formed by developing an electrostatic latent image formed on the photoreceptor from the photoreceptor to the intermediate transfer body by applying a transfer bias to the transfer member and putting the transfer member in contact with the intermediate transfer body, the method including: supplying the transfer member with a first constant current and acquiring a first voltage being a voltage occurring between the transfer member and the intermediate transfer body while the transfer member is being supplied with the first constant current; supplying the transfer member with a second constant current and acquiring a second voltage being a voltage occurring between the transfer member and the photoreceptor while the transfer member is being supplied with the second constant current; and acquiring a value indicating a thickness of the photoreceptor layer by using the first voltage and the second voltage.

BRIEF DESCRIPTION OF THE DRAWINGS

These and other objects, advantages, and features of the present invention will become apparent from the following description thereof taken in conjunction with the accompanying drawings, which illustrate specific embodiment(s) of the present invention.

In the drawings.

DESCRIPTION OF EMBODIMENT(S)

The following provides description taking as an example a case where the image forming apparatus pertaining to one aspect of the present invention is implemented as a color printer (referred to in the following as a printer) having the tandem system.

<Overall Structure of Printer>

Figure 1:
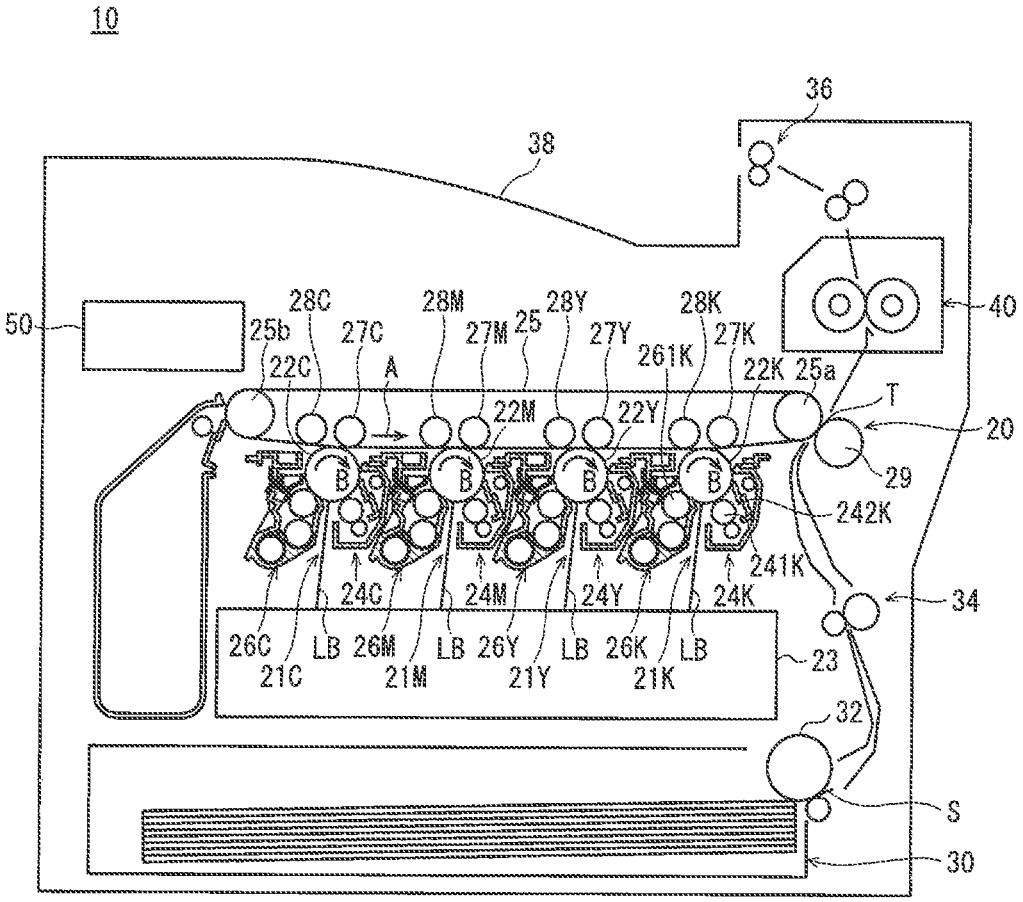
FIG. 1 illustrates the overall structure of a printer pertaining to an embodiment of the present invention.

FIG. 1 illustrates the overall structure of a printer 10 pertaining to the present embodiment.

As illustrated in FIG. 1, the printer 10 includes: an image former 20; a paper supplier 30; a fixing device 40; and a control unit 50. When the printer 10 is connected to a network such as a LAN and receives an instruction to execute a print job from an external terminal device (not illustrated in the drawings), the printer 10 forms toner images of the colors cyan, magenta, yellow, and black according to the instruction by using imaging units of the respective colors, and forms a color image through multiple transfer of the toner images.

In the following, the representation colors cyan, magenta, yellow, and black are respectively indicated by using the capital letters C, M, Y, and K. Further, a component related to one of these representation colors is indicated by appending the corresponding capital letter to the reference sign for the component.

The image former 20 includes imaging units 21C, 21M, 21Y, and 21K, respectively corresponding to the developing colors C, M, Y, and K. Further, the image former 20 includes a light exposure scanner 23 and an intermediate transfer belt 25.

Each of the imaging units 21C, 21M, 21Y, and 21K is a combination of a corresponding one among photoreceptor units 24C, 24M, 24Y, and 24K and a corresponding one among developer units 26C, 26M, 26Y, and 26K.

For example, the photoreceptor unit 24K includes a photoreceptor drum 22K, a charge roller 241K, and a cleaning blade 242K. For example, the developer unit 26K includes a developer roller 261K.

The imaging units 21C, 21M, and 21Y each have the same structure as the imaging unit 21K. Thus, the components included in the imaging units 21C, 21M, and 21Y are not provided with reference signs in FIG. 1.

The intermediate transfer belt 25 serves as an intermediate transfer body. The intermediate transfer belt 25 is an endless belt that is suspended in tension state between a drive roller 25*a* and a driven roller 25*b*, and rotates in the direction of the arrow A in FIG. 1 when driven (referred to in the following as belt running direction A).

The cleaning blades 242C, 242M, 242Y, and 242K each remove residual toner remaining on the circumferential surface of the corresponding one among the photoreceptor drums 22C, 22M, 22Y, and 22K. The charge rollers 241C, 241M, 241Y, and 241K each electrically charge the circumferential surface of the corresponding one among the photoreceptor drums 22C, 22M, 22Y, and 22K so that all areas of the circumferential surface have the same electric potential.

The light exposure scanner 23 includes light-emitting elements such as laser diodes. When receiving a drive signal from the control unit 50, the light exposure scanner 23 emits a laser LB for forming images of the colors C, M, Y, and K, and exposes the circumferential surfaces of the photoreceptor drums 22C, 22M, 22Y, and 22K, which rotate in the direction of the arrow B in FIG. 1, to the laser LB. Thus, an electrostatic latent image is formed on the photoreceptor drums 22C, 22M, 22Y, and 22K.

The electrostatic latent image formed on each of the photoreceptor drums 22C, 22M, 22Y, and 22K is developed through supply of toner via one among the developer rollers 261C, 261M, 261Y, and 261K of the corresponding one among the developer units 26C, 26M, 26Y, and 26K, and becomes a toner image of the corresponding one among the representation colors C, M, Y, and K.

Note that the forming of the electrostatic latent images of the different representation colors is performed at different timings, so that the toner images on the different photoreceptor drums 22C, 22M, 22Y, and 22K can be transferred onto the same position of the intermediate transfer belt 25 through primary transfer.

Specifically, the toner images of the different representation colors are transferred onto the intermediate transfer belt 25 one after another due to the electrostatic force exerted by the respective primary transfer rollers 27C, 27M, 27Y, and 27K. As a result, a color toner image is formed on the intermediate transfer belt 25. The intermediate transfer belt 25 carries the color toner image to a position T where secondary transfer takes place (referred to in the following as a secondary transfer position T).

Here, note that the image former 20 includes auxiliary primary transfer rollers 28C, 28M, 28Y, and 28K. Each of the auxiliary primary transfer rollers 28C, 28M, 28Y, and 28K urges the intermediate transfer belt 25 against the corresponding one among the photoreceptor drums 22C, 22M, 22Y, and 22K and thereby improves the contact between the intermediate transfer belt 25 and the corresponding photoreceptor drums 22C, 22M, 22Y, and 22K. Further, each of the auxiliary primary transfer rollers 28C, 28M, 28Y, and 28K is disposed upstream relative to the corresponding one among the primary transfer rollers 27C, 27M, 27Y, and 27K in the belt running direction A, such that each of the auxiliary primary transfer rollers 28C, 28M, 28Y, and 28K and the corresponding one of the primary transfer rollers 27C, 27M, 27Y, and 27K are located opposite one another with respect to a position of the intermediate transfer belt 25 that comes in contact with the corresponding one among the photoreceptor drums 22C, 22M, 22Y, and 22K.

Figure 3:
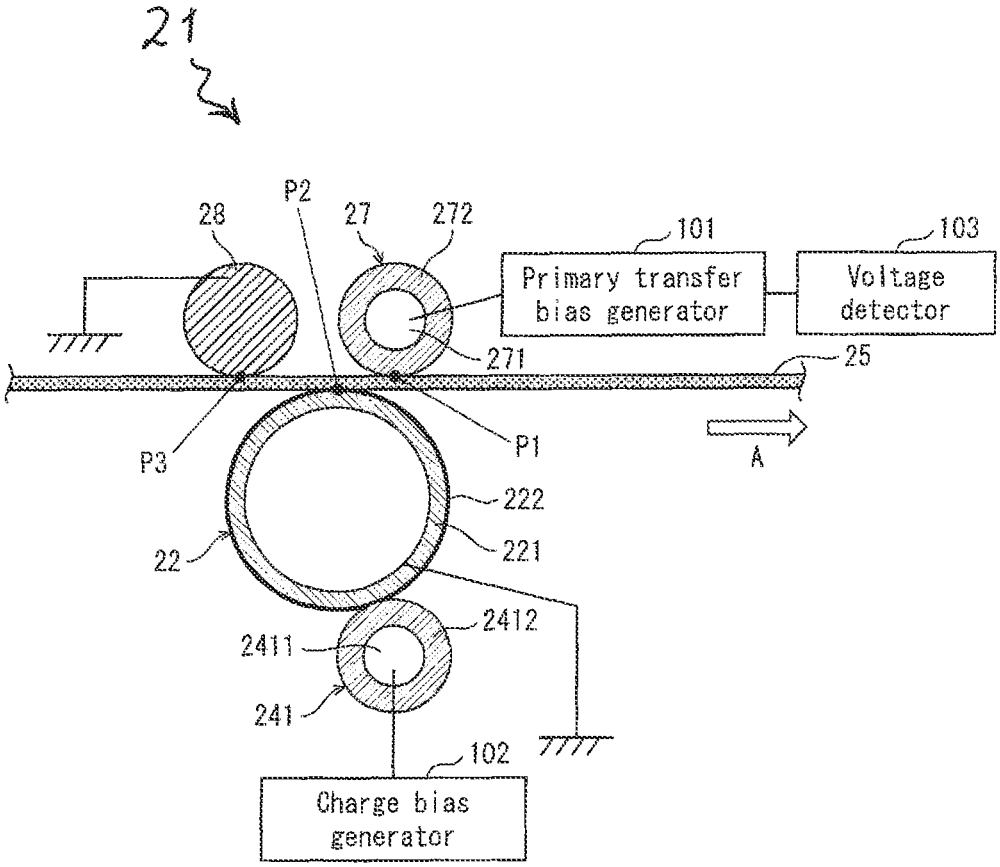
FIG. 3 is a schematic illustrating main components of an imaging unit of the printer that are related to charging and transferring.

The auxiliary primary transfer rollers 28C, 28M, 28Y, and 28K are each made of an electrically-conductive material such as a metal, and are each connected to the ground (illustrated in FIG. 3). Thus, the auxiliary primary transfer rollers 28C, 28M, 28Y, and 28K are each capable of preventing the occurrence of transfer noise by removing electric charge provided to the intermediate transfer belt 25 by the corresponding one among the primary transfer rollers 27C, 27M, 27Y, and 27K, in addition to releasing electric charge accumulating therein.

The paper supplier 30 includes a feed roller 32 and a pair of timing rollers 34. The paper supplier 30 supplies a recording sheet S to the secondary transfer position T so that the recording sheet S arrives at the secondary transfer position T at a similar timing as when the color toner image carried by the intermediate transfer belt 25 arrives at the secondary transfer position T. When the recording sheet S and the color toner image arrive at the secondary transfer position T, secondary transfer takes place, where the toner images of the colors C, M, Y, and K forming the color toner image are collectively transferred onto the recording sheet S due to the static force exerted by a secondary transfer roller 29.

The recording sheet S, after passing through the secondary transfer position T, is transported to the fixing device 40, where the toner images on the recording sheet S are fixed to the recording sheet S due to application of heat and pressure. Then, the recording sheet S is discharged onto a discharge tray 38 via a pair of discharge rollers 36.

The control unit 50 controls the image former 20, the paper supplier 30, and the fixing device 40 to execute printing.

Further, the printer 10 has, at an upper part of the front side of the housing, an operation panel 70 (not illustrated in FIG. 1 but illustrated in FIG. 2) provided at a position easily accessible by a user. The operation panel 70 is for receiving user input, and includes a display 71 implemented by using a liquid crystal touch panel. The operation panel 70 is capable of displaying, for example, an input screen and a status of the printer 10.

Note that each of the primary transfer rollers 27C, 27M, 27Y, and 27K in the present embodiment serves as a transfer member pertaining to the present invention, and each of the auxiliary primary transfer rollers 28C, 28M, 28Y, and 28K in the present embodiment serves as an auxiliary transfer member pertaining to the present invention.

<Structure of Control Unit 50>

Figure 2:
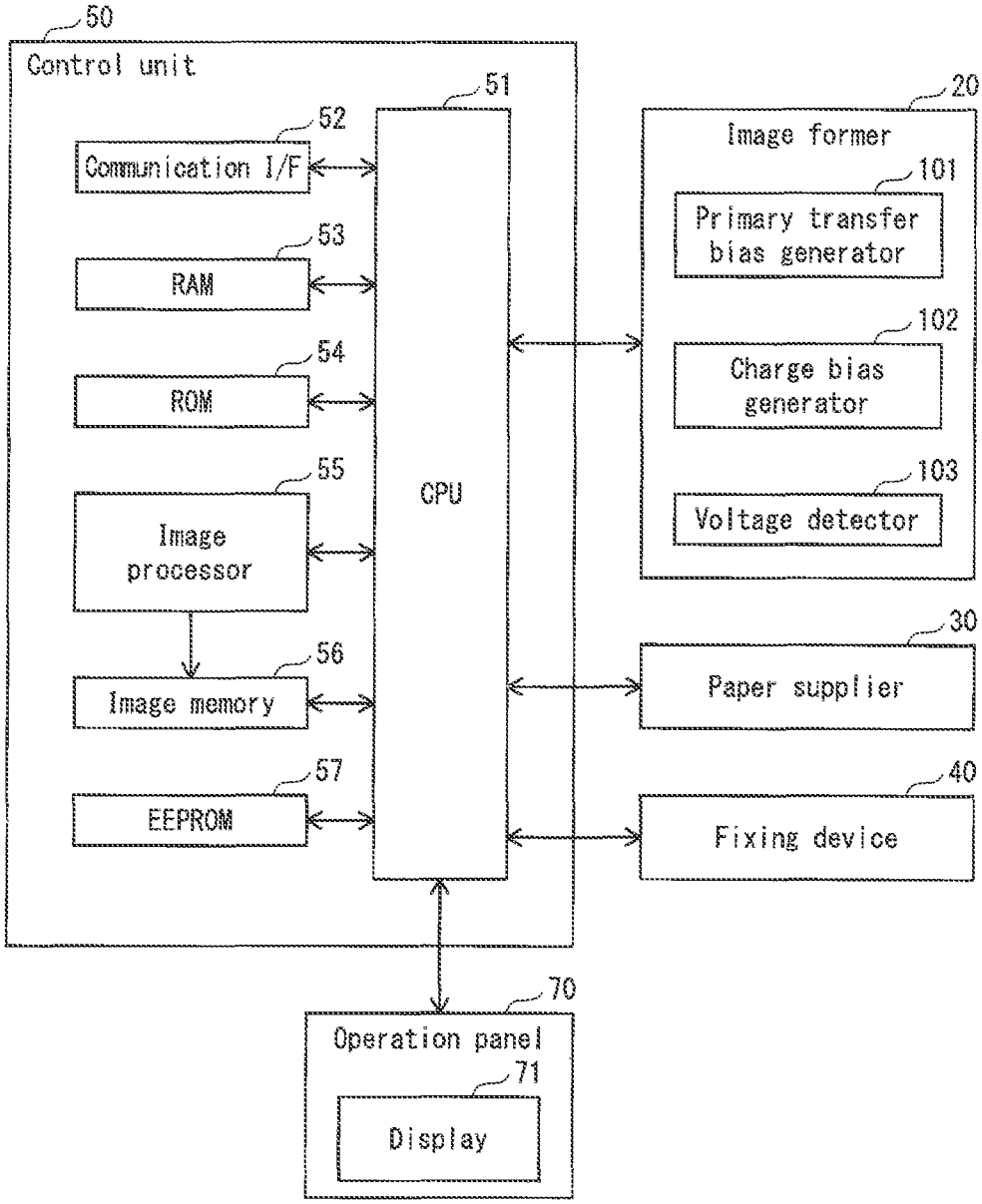
FIG. 2 is a block diagram illustrating the structure of a control unit of the printer.

FIG. 2 is a block diagram illustrating the structure of the control unit 50 of the printer 10.

As illustrated in FIG. 2, the control unit 50 includes, as main components thereof, a central processing unit (CPU) 51, a communication interface (I/F) 52, a random access memory (RAM) 53, a read-only memory (ROM) 54, an image processor 55, an image memory 56, and an electrically erasable programmable read-only memory (EEPROM) 57.

The communication I/F 52 is implemented by using a local access memory (LAN) card, a LAN card, or the like. The communication I/F 52 is connected to an external personal computer (PC) terminal (not illustrated in the drawings) via a wired or wireless LAN, and receives print jobs from the PC terminal.

The RAM 53 is used by the CPU 51 as a work area when the CPU 51 executes program(s) for image forming.

The ROM 54 stores, for example, various programs necessary for the operation of the printer 10, and information such as one or more threshold values of photoreceptor layer thickness. These threshold values are used for determining whether or not the end of the lifetime of a photoreceptor drum is approaching or has arrived.

The image processor 55 receives print jobs via the communication I/F 52. The image processor 55, for example, converts image data included in a print job, which may be represented by using the colors red (R), green (G), and blue (B), into image data represented by using the representation colors C, M, Y, and K, and performs necessary processing, such as smoothing, edge enhancement, and gamma correction, before storing the converted image data to the image memory 56.

The EEPROM 57 stores information such as the total number of sheets that the printer 10 has printed, and values indicating photoreceptor layer thickness acquired through processing for acquiring photoreceptor layer thickness, which is described in detail in the following. The EEPROM 57 may be implemented by using a writable non-volatile memory, such as a flash memory.

The CPU 51 reads out various programs stored in the ROM 54, and based on a print job that it receives via the communication I/F 52, controls the image former 20, the paper supplier 30, and the fixing device 40 so that printing is executed smoothly.

In addition, as described in detail in the following, the control unit 50 executes determination of photoreceptor drum lifetime for each of the photoreceptor drums 22C, 22M, 22Y, and 22K. Specifically, determination of photoreceptor drum lifetime of a given one among the photoreceptor drums 22C, 22M, 22Y, and 22K involves acquiring photoreceptor layer thickness of the photoreceptor drums 22C, 22M, 22Y and 22K and determining whether or not the end of the lifetime of the photoreceptor drums 22C-22M, 22Y, and 22K is approaching or has arrived.

<Determination of Photoreceptor Drum Lifetime>

1. Overview of Determination of Photoreceptor Drum Lifetime

FIG. 3 is a schematic illustrating main components of one imaging unit 21 that are related to charging of a photoreceptor drum and primary transfer. Since the imaging units 21C, 21M, 21Y, and 21K have the same structure as one another and differ from one another only in terms of the color of the toner supplied to the developer units 26C, 26M, 26Y, and 26K, the following provides description without appending the capital letters C, M, Y, and K to the reference signs of the components.

As illustrated in FIG. 3, the photoreceptor drum 22 is in contact with a lower surface (outside surface) of the intermediate transfer belt 25. Meanwhile, the primary transfer roller 27 and the auxiliary primary transfer roller 28 are in contact with an upper surface (inside surface) of the intermediate transfer belt 25.

The intermediate transfer belt 25 is implemented by using a film of a resin such as polyimide (PI). Further, the intermediate transfer belt 25 preferably has a surface resistivity within the range from 9 log Ω/sq to 12 log Ω/sq.

The photoreceptor drum 22 includes an elementary tube 221 that is made of a metal such as aluminum, and a photoreceptor layer 222 that is made of an organic photoreceptor and that is disposed to cover the circumferential surface of the elementary tube 221. The elementary tube 221 is connected to the ground. In the present embodiment, the photoreceptor layer 222 has an initial thickness of approximately 40 μm.

The charge roller 241 includes a shaft 2411 that is made of a metal, and an elastic layer 2412 that is made of an ionic conductive rubber and that is disposed to cover the circumferential surface of the shaft 2411. In a radial direction thereof, the elastic layer 2412 preferably has a resistance within the range from 3 log Ω to 6 log Ω.

Further, a charge bias generator 102 provides the shaft 2411 with a predetermined negative bias (charge bias).

The primary transfer roller 27 includes a shaft 271 that is made of a metal, and an elastic layer 272 that is made of an ionic conductive rubber and that is disposed to cover the circumferential surface of the shaft 271. In a radial direction thereof, the elastic layer 272 preferably has a resistance within the range from 6 log Ω to 8 log Ω.

Further, a primary transfer bias generator 101 provides the shaft 271 with a positive bias (primary transfer bias) for supplying the shaft 271 with predetermined constant currents.

Further, a voltage detector 103 detects the output voltage of the primary transfer bias generator 101 (i.e., the voltage of the shaft 271) when the primary transfer bias generator 101 supplies the shaft 271 with the predetermined constant currents.

Here, note that the smaller the thickness of the photoreceptor layer 222 of the photoreceptor drum 22 becomes due to abrasion, the lower the charging characteristic of the photoreceptor drum 22 becomes and the smaller the absolute value of the electric potential of the surface of the photoreceptor drum 22 becomes.

Specifically, since the photoreceptor layer 222 is dielectric, it can be considered that a capacitor is formed between the elementary tube 221 and a part of the charge roller 241 that is in contact with the photoreceptor layer 222. Thus, the following mathematical expressions hold true.

$$Q=C\times Vp \quad \text{[Math. 1]}$$

(where Q denotes the amount of electric charge that the charge roller 241 applies to the photoreceptor layer 222, C denotes the static capacity of the photoreceptor layer 222, and Vp denotes the electric potential of the surface of the photoreceptor layer 222.)

$$C=\in\times(S/d) \quad \text{[Math. 2]}$$

(where ∈ denotes the permittivity of the photoreceptor layer 222, S denotes the surface area of contact between the charge roller 241 and the photoreceptor layer 222, and d denotes the thickness of the photoreceptor layer 222.)

Further, based on [Math. 1] and [Math. 2], the following mathematical expression holds true.

$$Vp=Q\times d/\in S \quad \text{[Math. 3]}$$

As can be seen from [Math. 3], the electric potential Vp of the surface of the photoreceptor layer 222 and the thickness d of the photoreceptor layer 222 are directly proportional to one another. Due to this, a gradual decrease in thickness of the photoreceptor layer 222 results in a gradual decrease of the absolute value of the electric potential Vp of the surface of the photoreceptor layer 222 from its initial value at the beginning of use of the photoreceptor drum 22, as shown by the lower graph in FIG. 4. Specifically, as the thickness of the photoreceptor layer 222 decreases, the negative electric potential Vp of the surface of the photoreceptor layer 222 approaches zero.

Here, if electric resistance of a path of current flow extending from the shaft 271 to a contact position P1 where the primary transfer roller 27 and the intermediate transfer belt 25 are in contact with one another, and to a contact position P2 where the photoreceptor drum 22 and the intermediate transfer belt 25 are in contact with one another, when a constant current is supplied from the primary transfer bias generator 101 to the primary transfer roller 27, remains the same, a difference ΔVpr between the voltage Vr of the shaft 271 and the electric potential Vp of the surface of the photoreceptor drum 22 also should remain the same. Thus, a graph indicating a change in the voltage Vr occurring due to a change in photoreceptor layer thickness would be substantially parallel to a graph indicating a change in the electric potential Vp occurring due to the change in photoreceptor layer thickness, such that as the potential Vp increases, the voltage of the primary transfer roller 27 also increases proportionally (illustrated in the upper graph in FIG. 4).

Figure 4:
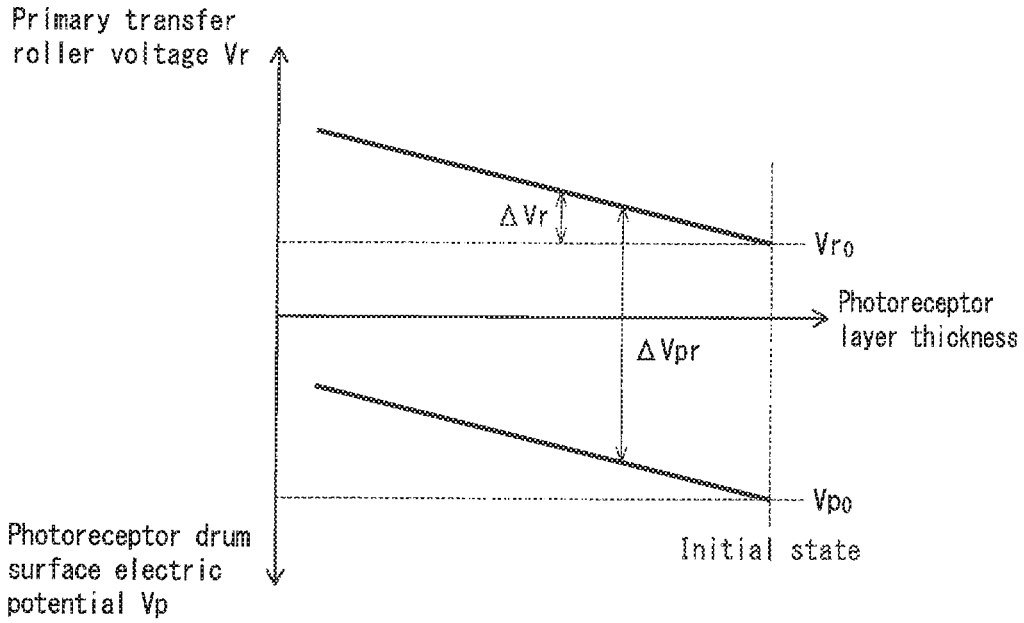
FIG. 4 shows a graph illustrating a relationship between photoreceptor layer thickness and electric potential of a photoreceptor drum surface when a primary transfer roller is supplied with a constant current, a graph illustrating a relationship between photoreceptor layer thickness and primary transfer roller voltage when the primary transfer roller is supplied with the constant current, and a correlation between the two graphs, assuming that resistance of the primary transfer roller does not change.

This means that, supposing that the voltage of the primary transfer roller 27 when supplied with a constant current (specifically, a later-described constant current Ic') is $Vr_0$ when the printer 10 is in an initial state where it has not performed any printing or it has performed barely any printing, a change $\Delta Vr$ ($=Vr-Vr_0$) in voltage of the primary transfer roller 27 at a certain point during usage should ideally be uniquely indicative of the photoreceptor layer thickness d at the certain point, as illustrated in FIG. 4.

However, this relationship between the change $\Delta Vr$ and the photoreceptor layer thickness d reasonably holds true only if the electrical resistance of a path of current flow extending from the shaft 271 to the contact position P1 (referred to in the following as a radial direction resistance of the primary transfer roller 27) remains the same. As already described above, this radial direction resistance actually tends to increase as the primary transfer roller 27 undergoes degradation over time. Further, particularly when the primary transfer roller includes an elastic layer made of an ionic conductive material (such as the primary transfer roller 27 pertaining to the present embodiment, which includes the elastic layer 272 made of an ionic conductive material), the radial direction resistance of the elastic layer 272 changes considerably depending upon surrounding conditions such as temperature and humidity.

In view of this, the following configurations are made in the present embodiment. First, a change in voltage of the primary transfer roller 27 occurring due to a change in the radial direction resistance is calculated, and a correction coefficient indicative of this change is acquired. Subsequently, a change in voltage of the primary transfer roller 27 that reflects only the change in electric potential of the photoreceptor drum 22 occurring due to abrasion of the photoreceptor layer 222 (referred to in the following as a reference voltage change $\Delta Vrs$ of the primary transfer roller 27) is acquired by using the correction coefficient. That is, the reference voltage change $\Delta Vrs$ does not reflect the change in voltage of the primary transfer roller 27 occurring due to the change in the radial direction resistance.

Figure 5:
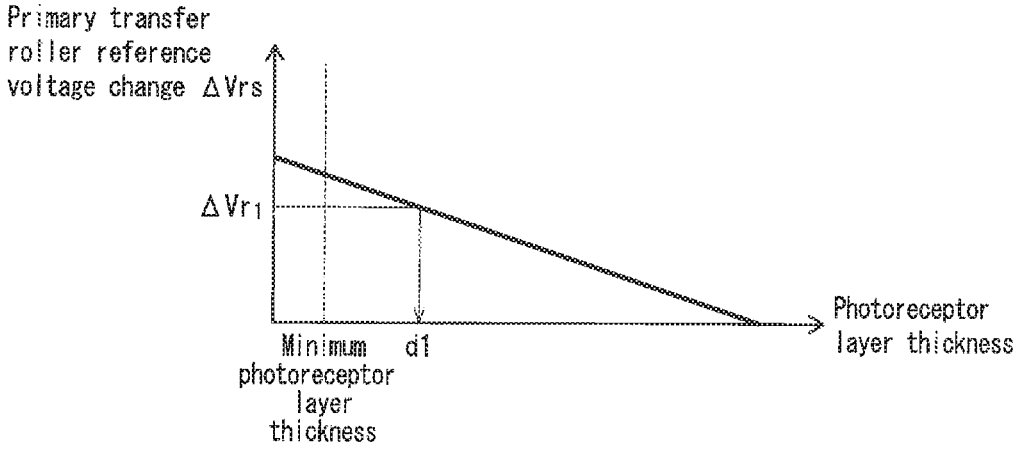
FIG. 5 is a graph illustrating, for the case illustrated in FIG. 4, a relationship between photoreceptor layer thickness and a change in the primary transfer roller voltage (reference voltage change)

When making such configuration the relationship between the reference voltage change $\Delta Vrs$ and the photoreceptor layer thickness d can be expressed by using a linear graph, as illustrated in FIG. 5. Due to this, the photoreceptor layer thickness d at any point in time can be easily acquired by calculating the reference voltage change $\Delta Vrs$ at the time point. For example, FIG. 5 illustrates calculating a photoreceptor layer thickness d1 at one time point based on an reference voltage change $\Delta Vr_1$ at the time point.

Further, in the present embodiment, a determination is made that the end of the lifetime of the photoreceptor drum 22 has arrived when the photoreceptor layer thickness d becomes equal to or smaller than a predetermined minimum, or that is, when the amount of abrasion-caused decrease of the photoreceptor layer thickness d becomes equal to or greater than a predetermined maximum.

The following describes the details of this determination of photoreceptor drum lifetime, with reference to flowcharts.

2. Flowcharts Describing Determination of Photoreceptor Drum Lifetime

Figure 6:
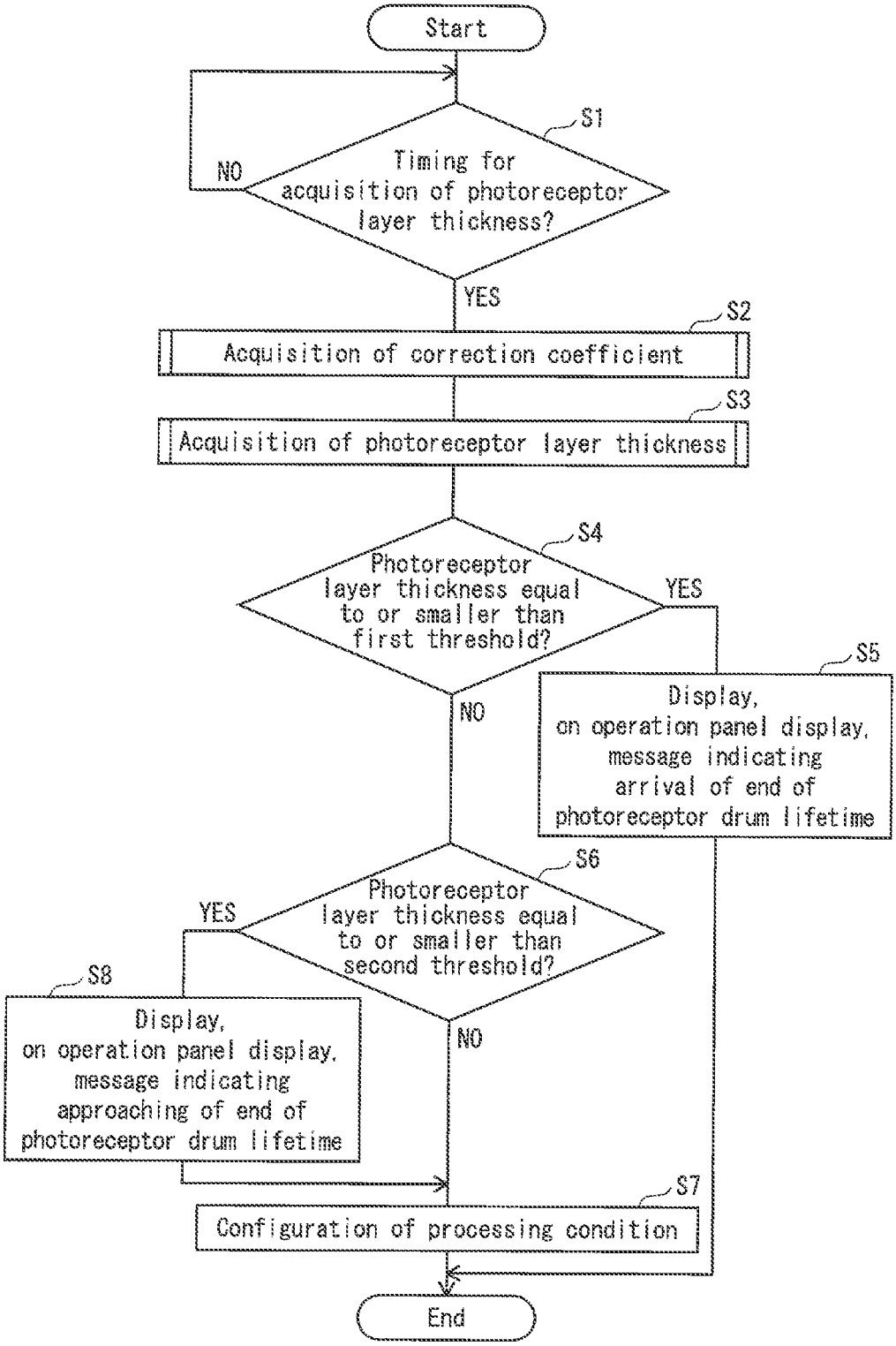
FIG. 6 is a flowchart illustrating an example of determination of photoreceptor drum lifetime executed by a control unit of the printer.

FIG. 6 is a flowchart illustrating the main routine of the determination of photoreceptor drum lifetime executed by the control unit 50.

Note that preferably, this processing is performed separately for each of the photoreceptors 22C, 22Y, 22M, and 22K. This is because charge rollers are used as photoreceptor drum chargers in the present embodiment, and not conventional corona chargers. Specifically, when using charge rollers, the amount of decrease in photoreceptor layer thickness of a photoreceptor drum is greatly dependent upon toner coverage of print-target images that have been actually printed, particularly toner coverage of the corresponding color. That is, the amount of decrease in photoreceptor layer thickness changes considerably depending upon the tone of the color images that have been actually printed.

First, the control unit 50 judges whether the timing for acquisition of photoreceptor layer thickness of the processing-target photoreceptor drum 22 has arrived. (Step S1)

The control unit 50 performs this judgment based on a count of the total number of sheets having been printed, which it stores to the EEPROM 57. For example, the control unit 50, when performing the judgment for the first time, may judge that the timing has arrived when the total number of printed sheets exceeds one thousand. After this, the control unit 50 may judge that the timing has arrived each time one thousand sheets have been printed since the last time it has executed the acquisition of photoreceptor layer thickness.

Note that a configuration may be made such that the imaging units 21C, 21M, and 21Y are completely stopped during monochrome printing where only the color black is used. When such a configuration is made, the control unit 50 may perform the judgment above for the photoreceptor drum 22K based on the total of the number of sheets printed in monochrome printing and the number of sheets printed in color printing, and on the other hand, may perform the judgment for each of the photoreceptor drums 22C, 22M, and 22Y, based on only the total number of sheets printed in color printing.

Further, instead of performing the judgment above based on a count of the total number of printed sheets, the control unit 50 may, for each photoreceptor drum 22, count the number of rotations of the photoreceptor drum 22 and judge that the timing has arrived for acquisition of photoreceptor layer thickness each time the photoreceptor drum 22 has performed a predetermined number of rotations.

Further, in the present embodiment, when the timing for acquisition of photoreceptor layer thickness arrives concurrently for multiple imaging units 21, the control unit 50 performs the acquisition for the imaging units 21 one after another (for example, starting from the imaging unit 21 that is located most upstream in the belt running direction A).

When judging that the timing for acquisition of photoreceptor layer thickness has arrived in Step S1 (YES in Step S1), the control unit 50 then acquires the correction coefficient (Step 52).

Figure 7:
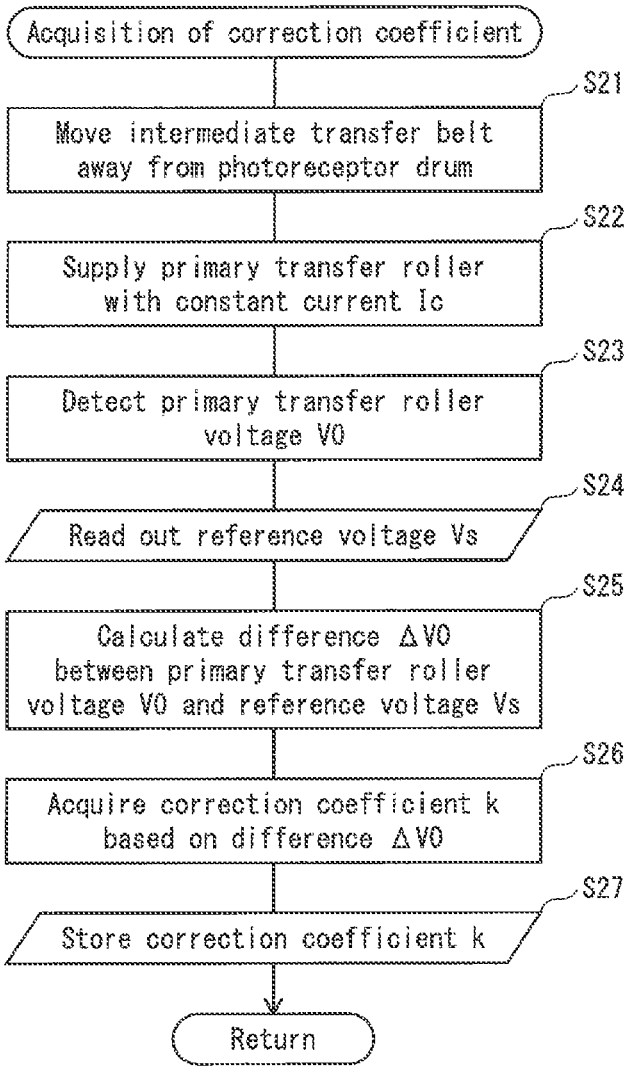
FIG. 7 is a flowchart illustrating a subroutine executed in acquisition of correction coefficient in Step S2 of FIG. 6.

This processing is mainly for acquiring the correction coefficient reflecting the change in radial direction resistance of the primary transfer roller 27, which is brought about by degradation of the primary transfer roller 27 over time and surrounding conditions of the primary transfer roller 27, such as temperature and humidity. Specifically, the subroutine illustrated in FIG. 7 is executed in acquisition of the correction coefficient.

Figure 9:
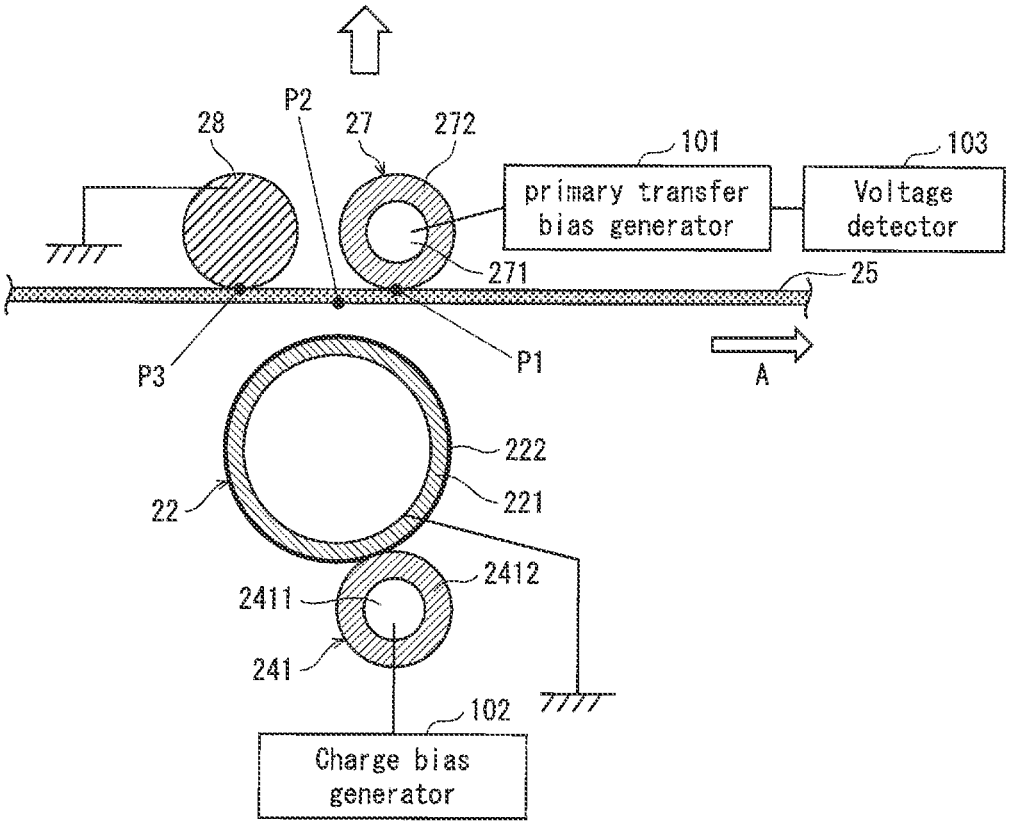
FIG. 9 illustrates a state where an intermediate transfer belt has been moved away from photoreceptor drums, in the execution of the acquisition of correction coefficient.

First, the control unit 50 moves the intermediate transfer belt 25 away from the photoreceptor drums 22 while maintaining the contact between the intermediate transfer belt 25 and the primary transfer rollers 27 and the auxiliary primary transfer rollers 28, as illustrated in FIG. 9 (Step S21).

Figure 10:
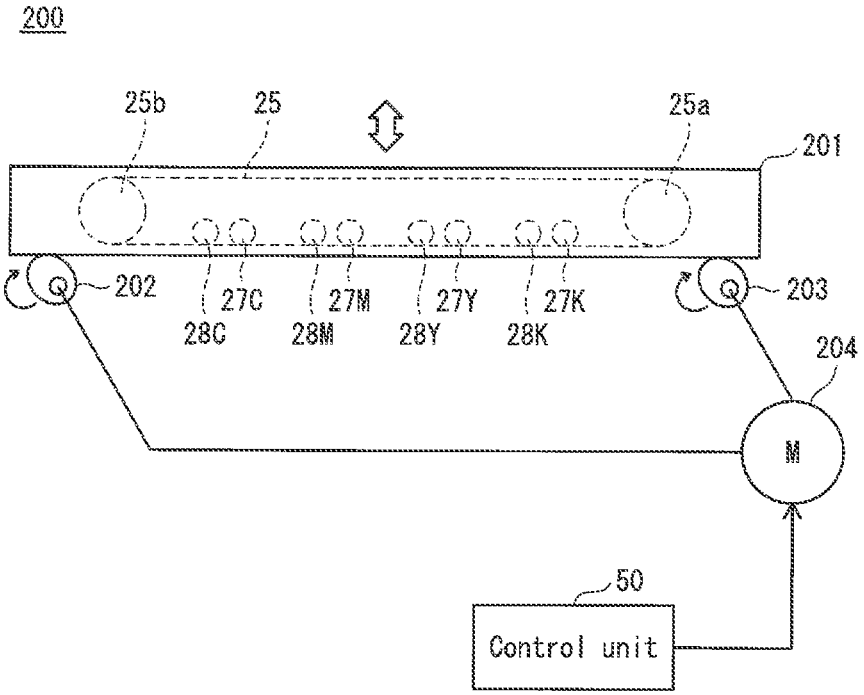
FIG. 10 illustrates one example of a separation mechanism for moving the intermediate transfer belt away from the photoreceptor drums.

FIG. 10 illustrates one example of a separation mechanism 200 for moving the intermediate transfer belt 25 away from the photoreceptor drums 22.

As illustrated in FIG. 10, rollers 25*a* and 25*b* across which the intermediate transfer belt 25 is suspended in tension state, the primary transfer rollers 27C, 27M, 27Y, and 27K, and the auxiliary primary transfer rollers 28C, 28M, 28Y, and 28K are each rotatably supported by a shaft fixed to a frame 201.

The frame 201 is attached to a main frame (not illustrated in the drawings) of the printer 10 so as to be parallelly translatable up and down. Further, the frame 201 has cam-receiving surfaces (not illustrated in the drawings) at the lower side thereof. The cam-receiving surfaces are put in contact with the circumferential surfaces of cams 202 and 203, and by causing the cams 202 and 203 to rotate in sync with each other by using a motor 204, the intermediate transfer belt 25, the primary transfer rollers 27C, 27M, 27Y, and 27K, and the auxiliary primary transfer rollers 28C, 28M, 28Y, and 28K can all be moved up and down at the same time.

Here, the control unit 50 controls the motor 204 to control the rotation amount of the cams 202 and 203 such that the frame 201 is moved up when moving the intermediate transfer belt 25 away from the photoreceptor drums 22, and the frame 201 is moved to the lowest possible position when putting the intermediate transfer belt 25 in contact with the photoreceptor drums 22.

Note that regular printers having the tandem system include, as standard equipment, a mechanism for moving photoreceptor drums and an intermediate transfer belt away from one another. Thus, it is unnecessary to provide the above-described separation mechanism 200 newly to such printers, and thus, the separation mechanism 200 does not bring about any increase in cost.

Conventional printers are provided with such a mechanism for the two following reasons.

The first reason is that, when executing processing before or after printing with the photosensitive drums and/or the intermediate transfer belt (e.g., processing of causing a photoreceptor drum to rotate in a reverse direction to remove paper dust and the like remaining between the photoreceptor drum and a cleaning blade), it is desirable to move the photoreceptor drums away from the intermediate transfer belt so that the photoreceptor drums of imaging units of different representation colors can perform the processing separately. This is desirable to ensure that the time for which a given photoreceptor drum rotates for the processing does not affect the lifetime of the rest of the photoreceptor drums.

The second reason is that making a configuration such that the set of the photoreceptor drums of the representation colors C, M, and Y is movable away from the intermediate transfer belt separately from the photoreceptor drum for the representation color K is beneficial. Specifically, by moving the photoreceptor drums of the representation colors C, M, and Y away from the intermediate transfer belt during monochrome printing, the photoreceptor drums of the representation colors C, M, and Y, which actually do not perform any printing, can be prevented from rotating in sync with the rotation of the photoreceptor drum for the representation color K. This results in an extension in lifetime of these photoreceptors.

Needless to say, the separation mechanism 200 need not have the structure described above. That is, the separation mechanism 200 may have any structure enabling moving the intermediate transfer belt 25 away from the photoreceptor drums 22 while maintaining the contact between the intermediate transfer belt 25 and the primary transfer rollers 27 and the auxiliary primary transfer rollers 28.

Returning to FIG. 7, after causing the intermediate transfer belt 25 to move away from the photoreceptor drums 22, the control unit 50 supplies a constant current Ic (first constant current) to the primary transfer roller 27 (Step S22). Note that the constant current Ic is preferably within the range from 50 μA to 200 μA, and in the present embodiment, the constant current Ic is set to 100 μA.

The primary transfer bias generator 101 includes a conventional constant current circuit, and controls the primary transfer bias applied to the shaft 271 for supplying the constant current Ic to the primary transfer roller 27.

Then, the control unit 50 causes the voltage detector 103 to detect the voltage of the shaft 271 (i.e., the output voltage of the primary transfer bias generator 101) (Step S23). Note that in the following, the voltage of the shaft 271 when the constant current Ic is supplied to the primary transfer roller 27 is referred to as a voltage V0.

Figure 11A:
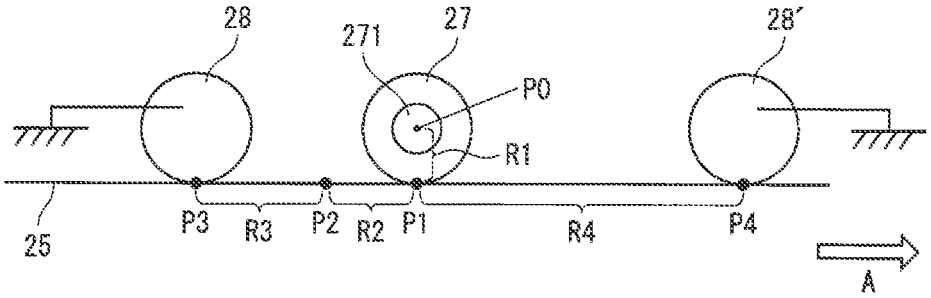
FIG. 11A illustrates resistance at different positions along a path of current flow formed when a primary transfer bias is applied to the first primary transfer roller in the execution of the acquisition of correction coefficient.

FIG. 11A illustrates resistance at different positions along a path of current flow formed when the primary transfer bias is applied to the first primary transfer roller 27 with the intermediate transfer belt 25 moved away from the photoreceptor drums 22. Further, FIG. 11B is an equivalent circuit of the path of current flow in FIG. 11A.

Figure 11B:
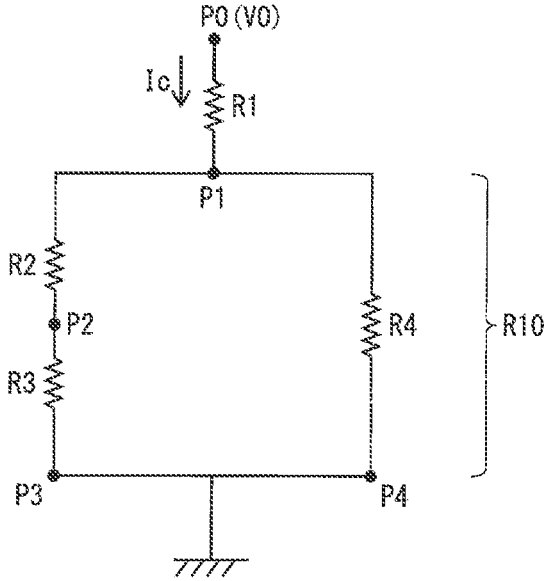
FIG. 11B is an equivalent circuit of the path of current flow in FIG. 11A.

Here, because the shafts 271 of the primary transfer rollers 27 and the auxiliary primary transfer rollers 28 are made of a metal material and thus are electrically conductive, and further because the auxiliary primary transfer rollers 28 are connected to the ground, it can be considered that an equivalent circuit such as that illustrated in FIG. 11B is formed between the shaft 271 of a primary transfer roller 27 of a first imaging unit 21 including the processing-target photoreceptor drum 22, an auxiliary primary transfer roller 28 of the first imaging unit 21, and an auxiliary primary transfer roller 28' of a second imaging unit 21 located adjacent to the first imaging unit 21 downstream in the belt running direction A, based on FIG. 11A. In FIG. 11A, the radial direction resistance of the elastic layer 272 of the primary transfer roller 27 (i.e., the electric resistance between the shaft 271 (PO) and contact position P1) is indicated by R1, the resistance between contact position P1 and contact position P2 is indicated by R2, the resistance between contact position P2 and contact position P3 where the intermediate transfer belt 25 is in contact with the auxiliary primary transfer roller 28 of the first imaging unit 21 is indicated by R3, and the resistance between contact position P1 and contact position P4 where the intermediate transfer belt 25 is in contact with the auxiliary primary transfer roller 28' of the second imaging unit 21 is indicated by R4.

Based on the equivalent circuit illustrated in FIG. 11B, the following mathematical expression holds true.

$$V0=Ic\times(R1+R10) \quad \text{[Math. 4]}$$

In [Math. 4], R10 denotes the combined resistance between contact position P1 and the ground, and the following mathematical expression holds true in connection with R10.

$$1/R10=1/(R2+R3)+1/R4 \quad \text{[Math. 5]}$$

Here, note that when the photoreceptor drum 22K, which is located most downstream in the belt running direction A among the photoreceptor drums 22, is the processing-target photoreceptor drum, resistance R4 indicates the resistance in the belt running direction A between contact position P1 and a contact position where the intermediate transfer belt 25 is in contact with the auxiliary primary transfer roller 28C.

Note that when the photoreceptor drum 22K is the processing-target photoreceptor drum as described above, the value of resistance R4 would be much greater than the values of resistance R2 and resistance R3. Thus, in this case, 1/R4 in [Math. 5] may be approximated with zero.

Returning to FIG. 7, subsequently, the control unit 50 reads out a reference voltage Vs from the ROM 54 (Step S24).

This reference voltage Vs is the voltage of the shaft 271 of the primary transfer roller 27 (also may be referred to in the following as the voltage of the primary transfer roller 27) detected when the constant current Ic is supplied to the primary transfer roller 27 with the printer 10 in a standard state. The standard state of the printer 10 is, for example, a state of the printer 10 before shipping from a factory where the printer 10 has been left untouched for a predetermined amount of time under predetermined conditions (e.g., temperature at 23 degrees Celsius and the relative humidity at 65%).

Subsequently, the control unit 50 calculates a difference ΔV0 between the voltage V0 detected in Step S23 and the reference voltage Vs (Step S25).

Here, when denoting the radial direction resistance of the primary transfer roller 27 when the printer 10 is in the standard state as Rs and supposing that the change in resistance of the intermediate transfer belt 25, if any, is smaller enough than the change in resistance of the primary transfer roller 27 so that it can be ignored, the following mathematical expression holds true.

$$\Delta V0=V0-Vs=Ic\times(R1+R10)-Ic\times(Rs+R10)=Ic\times(R1-Rs) \quad \text{[Math. 6]}$$

Because the constant current Ic is not changed, the difference ΔV0 defined in [Math. 6] reflects a change ΔR1 (=R1−Rs) in radial direction resistance of the primary transfer roller 27, which is brought about by degradation of the elastic layer 272 over time and surrounding conditions of the elastic layer 272.

Accordingly, the control unit 50 subsequently calculates, based on the difference ΔV0, the correction coefficient (referred to in the following as a correction coefficient k) (Step S26). As described above, the correction coefficient k is used in calculating the reference voltage change ΔVrs (illustrated in FIG. 5), and indicates the change in the voltage of the primary transfer roller 27 excluding that occurring due to the change in radial direction resistance of the primary transfer roller 27.

For example, the correction coefficient k may be calculated by using the following mathematical expression.

$$k=\Delta V0/Ic \quad \text{[Math. 7]}$$

Subsequently, the control unit 50 causes the EEPROM 57 (illustrated in FIG. 2) to store the correction coefficient k so calculated (Step S27). Then, the control unit 50 returns to the main routine illustrated in FIG. 6.

Returning to FIG. 6, subsequently, the control unit 50 performs the acquisition of photoreceptor layer thickness by using the correction coefficient k (Step S3).

Figure 8:
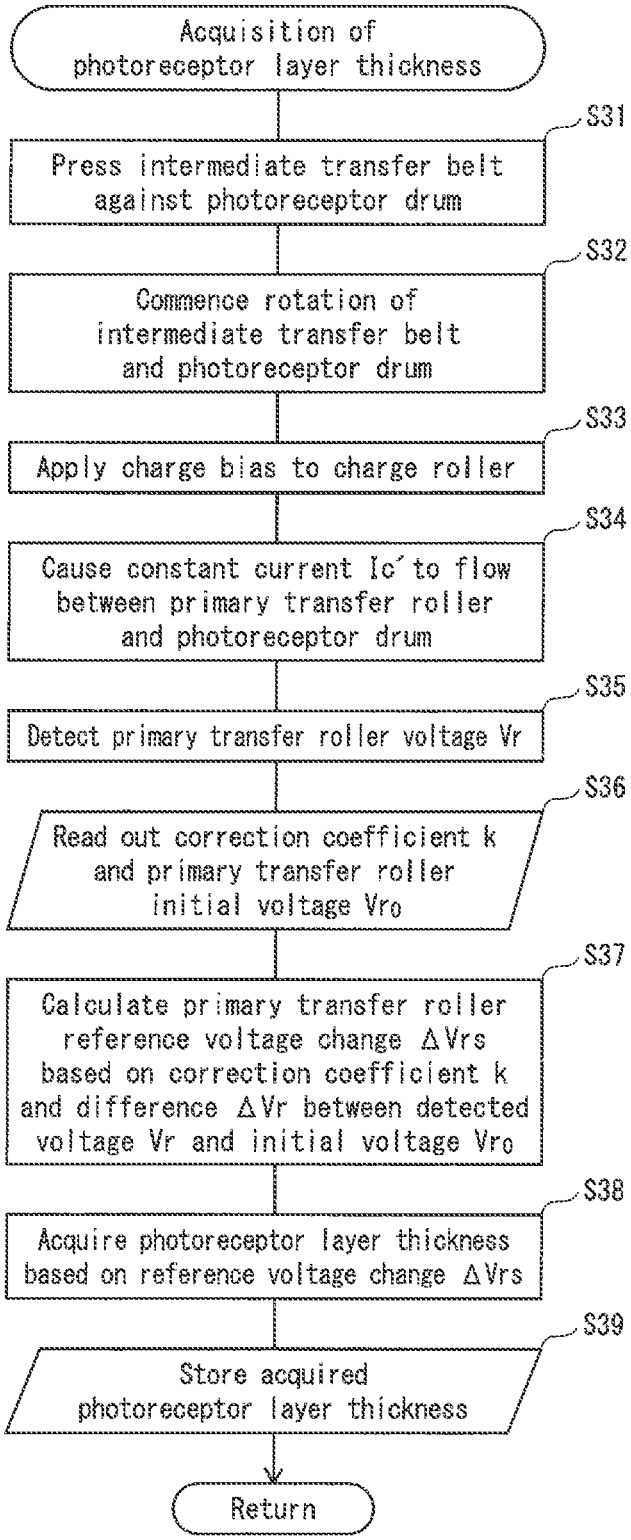
FIG. 8 is a flowchart illustrating a subroutine executed in acquisition of photoreceptor layer thickness in Step S3 of FIG. 6.

FIG. 8 is a flowchart illustrating the sub-routine executed in the acquisition of photoreceptor layer thickness.

First, the control unit 50 controls the separation mechanism 200 (illustrated FIG. 10) to lower the frame 201 so that the intermediate transfer belt 25 comes in contact with (presses against) the photoreceptor drums 22 as illustrated in FIG. 3 (Step S31).

Subsequently, the control unit 50 causes the intermediate transfer belt 25 and the photoreceptor drum 22 to rotate similar to in actual printing (Step S32). Subsequently, the control unit 50 causes the charge bias generator 102 to apply the charge bias (preferably a constant voltage within the range from 300V to 1 kV, and for example 500V in the present embodiment) to the charge roller 241, and thereby causes the photoreceptor drum 22 to be charged (Step S33).

Then, the control unit 50 causes the primary transfer bias generator 101 to apply the primary transfer bias to the primary transfer roller 27 (Step S34), so that the constant current Ic' (second constant current; preferably a current within the range from 10 μA to 100 μA, and for example 30 μA in the present embodiment) flows through the primary transfer roller 27.

Subsequently, the control unit 50 causes the voltage detector 103 to detect the voltage Vr of the primary transfer roller 27 when the primary transfer bias is applied to the primary transfer roller 27 (Step S35). Then, the control unit 50 reads out, from the EEPROM 57, the correction coefficient k and the voltage Vr0 (illustrated in FIG. 4) of the primary transfer roller 27 when the constant current Ic' is applied to the primary transfer roller 27 when the printer 10 is in its initial state (Step S36).

Subsequently, the control unit 50 calculates the reference voltage change ΔVrs (illustrated in FIG. 5) as described in the following (Step S37).

First, the control unit 50 calculates the difference ΔVr (=Vr−$Vr_0$) between the detected voltage Vr and the initial voltage $Vr_0$.

This difference ΔVr can be expressed as ΔVr=ΔVp+ΔV1'. That is, the difference ΔVr includes both (i) the change ΔVp in electric potential of the surface of the photoreceptor drum 22 from when the printer 10 was in the initial state, which is brought about by the change in photoreceptor layer thickness, and (ii) a change ΔV1' in the voltage of the primary transfer roller 27 brought about by the change in resistance of the primary transfer roller 27, which is brought about by degradation of the primary transfer roller 27 over time and surrounding conditions of the primary transfer roller 27.

Here, because the voltage $Vr_0$ is the voltage of the primary transfer roller 27 having been detected at a time point close to the time point when the detection of the reference voltage Vs was performed (Step S25 in FIG. 7) with the printer 10 under the same conditions, the change ΔR1 used in the acquisition of the correction coefficient k in FIG. 7 should also be applicable in the acquisition of the photoreceptor layer thickness in FIG. 8. Thus, ΔV1'=ΔR1×Ic'=(ΔV1/Ic)×Ic' holds true.

Because ΔV1/Ic equals the correction coefficient k calculated in Step S26 of FIG. 7, ΔV1'=k×Ic' holds true, and then ΔVp=ΔVr−k×Ic' holds true.

As already described above, the reference voltage change ΔVrs is the change in voltage of the primary transfer roller 27 that is brought about solely by increase in the electric potential Vp of the surface of the photoreceptor drum 22, and thus does not reflect the change in resistance of the primary transfer roller 27. Due to this, the reference voltage change ΔVrs is equal to the change ΔVp in electric potential of the surface of the photoreceptor drum 22, which is brought about by change in photoreceptor layer thickness. Thus, the reference voltage change ΔVrs can be expressed as: ΔVrs=ΔVp=ΔVr−k×Ic'.

Subsequently, the control unit 50 calculates the photoreceptor layer thickness by using the reference voltage change ΔVrs so calculated and referring to the graph in FIG. 5 (Step S38). In the following, description is provided supposing that the reference voltage change ΔVrs equals $\Delta Vr_1$. Thus, in this case, the control unit 50 acquires the photoreceptor layer thickness d1 based on FIG. 5.

Specifically, a function or a table indicative of the graph in FIG. 5 is calculated in advance through experimentation or the like, and is stored to the ROM 54, and the control unit 50 (i.e., the CPU 51) acquires the photoreceptor layer thickness by referring to the function or the table.

Subsequently, the control unit 50 stores the photoreceptor layer thickness d1 so acquired to the EEPROM 57 (Step S39). Then, the control unit 50 returns to the main routine illustrated in FIG. 6.

Returning to FIG. 6, subsequently, the control unit 50 judges whether or not the photoreceptor layer thickness d1 is equal to or smaller than a first threshold dt1 (for example, 10 μm) (Step S4).

When judging that the photoreceptor layer thickness d1 is equal to or smaller than the first threshold dt1 (YES in Step S4), the control unit 50, judging that the end of the lifetime of the photoreceptor drum 22 (e.g., the photoreceptor drum 22K) has arrived, causes the display 71 of the operation panel 70 to display a message urging replacement of the photoreceptor drum 22 (Step S5).

Meanwhile, when judging that the photoreceptor layer thickness d1 is greater than the first threshold dt1 (NO in Step S4), the control unit 50 judges whether or not the photoreceptor layer thickness d1 is equal to or smaller than a second threshold dt2 (Step S6).

Here, the second threshold dt2 is set to be greater than the first threshold dt1 by a predetermined level. For example, when denoting the initial photoreceptor layer thickness as d0, the second threshold dt2 may be set to satisfy dt2=dt1+(d0−dt1)×0.95.

When judging that the photoreceptor layer thickness d1 is greater than the second threshold dt2 (NO in Step S6), the control unit 50 makes a configuration of a processing condition (a condition to be applied in image forming).

In the present embodiment, in Step S7, the control unit 50 makes a configuration of adjusting the level of the constant current that the primary transfer bias generator 101 supplies to the primary transfer roller 27 in image forming, depending upon the photoreceptor layer thickness d1.

Specifically, the control unit 50 adjusts the primary transfer bias that the primary transfer generator 101 applies so that the primary transfer roller 27 is supplied with a constant current having a value that is a product of a value of a constant current initially set to the primary transfer bias generator 101 when the photoreceptor layer 222 has the initial thickness and a correction coefficient x (x≥1) determined based on the photoreceptor layer thickness d1.

Here, the relationship between the correction coefficient x and the photoreceptor layer thickness d is determined in advance through experimentation or the like in order to prevent degradation of transfer images, and a function or a table indicative of the relationship is stored to the ROM 54 in advance.

Thus, the control unit 50 reads out, from the ROM 54, a correction coefficient corresponding to the photoreceptor layer thickness d1 calculated in Step S3, and controls the primary transfer bias generator 101 so that the primary transfer roller 27 is supplied with a constant current having a value that is a product of the value of the constant current initially set to the primary transfer bias generator 101 and the correction coefficient read out, thereby ensuring that appropriate transfer images are generated.

Meanwhile, when judging that the photoreceptor layer thickness d1 is equal to or smaller than the second threshold dt2 (YES in Step S6), the control unit 50 causes the display 71 of the operation panel 70 to display a message indicating that the end of the lifetime of the photoreceptor drum 22 is approaching to urge the user to prepare for the replacement of the photoreceptor drum 22 (Step S8).

Subsequently, the control unit 50 makes the configuration of a processing condition (Step S7), whereby the photoreceptor drum lifetime determination is terminated.

Note that when the printer 10 is connected to the Internet via a LAN, a configuration may be made such that the information that is displayed on the display 71 in Steps S5 and S8 is transmitted, along with information identifying the printer 10, to a maintenance company or a service technician via the Internet. With this configuration, the user would not have to take the trouble to contact a maintenance company or a service technician for photoreceptor drum replacement, and thus it can be ensured that photoreceptor drum replacement is carried out promptly and smoothly.

As described up to this point, in the present embodiment, a correction coefficient to be mainly used for eliminating the influence of change in resistance of the primary transfer roller 27 is first calculated by moving the intermediate transfer belt 25 away from the photoreceptor drums 22 and supplying the primary transfer roller 27 with a constant current Ic (first constant current). Then, after putting the intermediate transfer belt 25 in contact with the photoreceptor drums 22 and causing the charge roller 241 to electrically charge the photoreceptor drum 22, the primary transfer roller 27 is supplied with a constant current Ic' (second constant current). Further, a change from an initial state of the voltage of the primary transfer roller 27 when supplied with the constant current Ic' is calculated, and based on this change and the correction coefficient, the reference voltage change ΔVrs of the primary transfer roller 27, which does not reflect the change in resistance of the primary transfer roller 27, is calculated. Thus, the photoreceptor layer thickness can be acquired accurately based on the reference voltage change ΔVrs.

The present embodiment enables accurate acquisition of photoreceptor layer thickness without having to introduce any expensive measurement device such as a laser distance measurement device or a surface potential measurement device, because the primary transfer bias generator 101, the charge bias generator 102, the voltage detector 103, and the like are all components included in conventional printers. Thus, the present embodiment achieves accurate acquisition of photoreceptor layer thickness without bringing about an increase in printer manufacturing cost.

Note that in the present embodiment, the control unit 50 serves as a constant current supplier pertaining to the present invention when controlling the primary transfer bias generator 101 to execute the processing in Step S22 in FIG. 7 to supply the primary transfer roller 27 with the first constant current and the processing in Step S34 in FIG. 8 to supply the primary transfer roller 27 with the second constant current. Further, in the present embodiment, the control unit 50 serves as a first voltage acquirer pertaining to the present invention when acquiring the voltage of the primary transfer roller 27 while being supplied with the first constant current via the voltage detector 103 (Step S23 in FIG. 7), and serves as a second voltage acquirer pertaining to the present invention when acquiring the voltage of the primary transfer roller 27 while being supplied with the second constant current via the voltage detector 103 (Step S35 in FIG. 8). Further, in the present embodiment, the control unit 50 serves as a photoreceptor thickness acquirer pertaining to the present invention when executing Step S38 in FIG. 8.

<Modifications>

Up to this point, the present invention is described based on a specific embodiment thereof. Needless to say, the present invention is not limited to the specific embodiment described above, and shall be construed as including the modifications described in the following.

1. In the embodiment, photoreceptor layer thickness is acquired by supplying a constant current to detect the voltage between a primary transfer roller 27 and auxiliary primary transfer rollers 28 in the acquisition of a correction coefficient, and supplying a constant current to detect the voltage between a primary transfer roller 27, the intermediate transfer belt 25, and a photoreceptor drum 22 in the acquisition of photoreceptor layer thickness.

Alternatively, the acquisition of photoreceptor layer thickness may be performed based on a thickness-direction resistance of the photoreceptor layer that can be calculated based on the voltages detected by supplying constant currents.

The following describes one example of how the thickness-direction resistance of the photoreceptor layer can be calculated.

First, with the intermediate transfer belt 25 not in contact with the photoreceptor drums 22 (refer to FIGS. 9, 11A, and 11B), the constant current Ic is supplied to the primary transfer roller 27. Further, the radial direction resistance R1 of the primary transfer roller 27 is calculated based on the voltage V0 of the shaft 271 detected while the primary transfer roller 27 is being supplied with the constant current Ic.

Here, note that the resistance of the intermediate transfer belt 25 is already known at the point of design. Further, supposing that the resistance of the intermediate transfer belt 25 per unit length in the belt running direction A is Ru, the resistance between pairs of contact positions of the intermediate transfer belt 25 (i.e., the resistance R2, R3, and R4) can be easily calculated by multiplying the resistance Ru per unit length by the distance between the two contact positions. The distance between pairs of contact positions of the intermediate transfer belt 25 is also determined at the point of design.

For example, supposing that the distance between the contact positions P1 and P2 is L1, the resistance R2 can be calculated as R2=Ru×L1. In this modification, the resistance between pairs of contact positions is calculated in advance and stored to the ROM 54. Thus, by using resistance R2, R3, and R4, and [Math. 5] presented above, the combined resistance R10 (illustrated in FIG. 11B) can be easily calculated.

Further, the relationship between the constant current Ic and the voltage V0 of the shaft 271 when the primary transfer roller 27 is supplied with the constant current Ic is expressible as V0=Ic×(R1+R10). Based on this, the radial direction resistance R1 of the primary transfer roller 27 can be calculated as R1=(V0/Ic)−R10.

Subsequently, with the intermediate transfer belt 25 in contact with the photoreceptor drums 22, the constant current Ic' is supplied to the primary transfer roller 27.

Figure 12A:
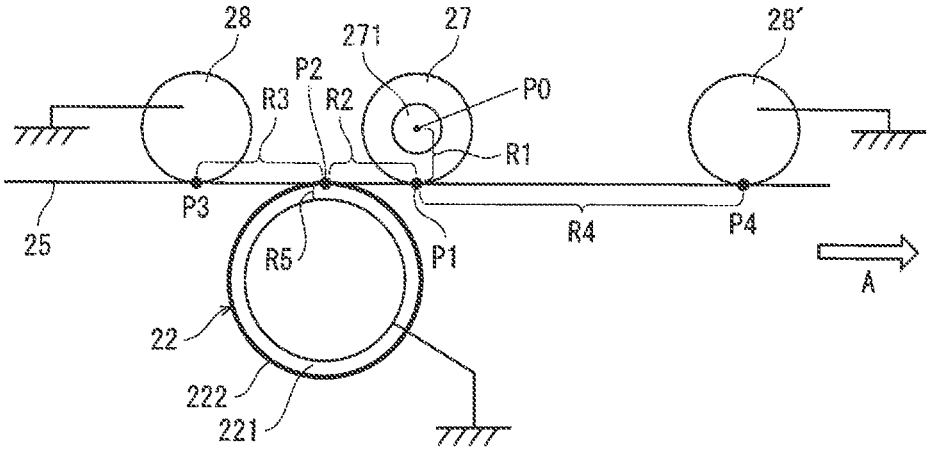
FIGS. 12A and 12B are diagrams describing acquisition of photoreceptor layer thickness pertaining to a modification of the present invention, with FIG. 12A illustrating resistance at different positions along a path of current flow formed when the primary transfer bias is applied to the first primary transfer roller and FIG. 12B being an equivalent circuit of the path of current flow in FIG. 12A.

FIG. 12A illustrates a path of current flow formed when the intermediate transfer belt 25 is put in contact with the photoreceptor drums 22 and the primary transfer bias is applied to the first primary transfer roller 27, with indication of resistance at different positions of the path of current flow. Note that FIG. 12A, in addition to the resistance at the positions of the path of current flow illustrated in FIG. 11A, illustrates the resistance R5 between the contact position P2 and the elementary tube 221 of the photoreceptor drum 22 (i.e., the thickness direction resistance of the photoreceptor layer 222). Further, FIG. 12B is an equivalent circuit of the path of current flow in FIG. 12A.

Note that in the present modification, the constant current Ic' is supplied to the primary transfer roller 27 without the photoreceptor 22 being charged by the charge roller 241. Here, it is preferable to destaticize the photoreceptor drum 22 beforehand by applying only an alternating voltage to the charge roller 241.

Figure 12B:
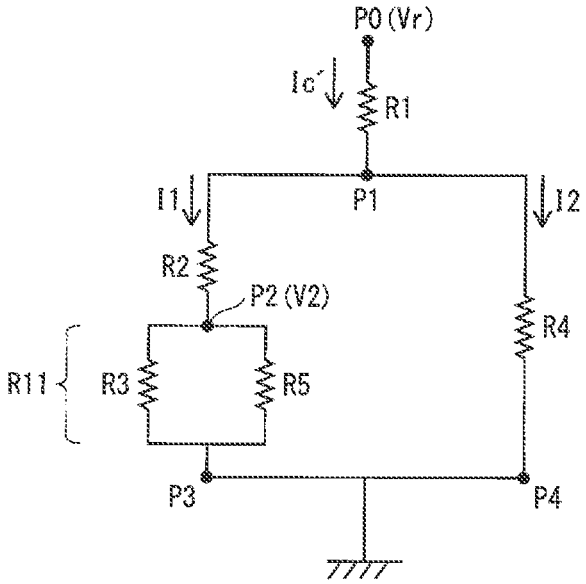

In FIG. 12B, when denoting the combined resistance of resistance R3 and resistance R5 as resistance R11, and denoting the current flowing through resistance R2 and the current flowing through resistance R4 as current I1 and I2, respectively, the following mathematical expressions hold true.

$$I1+I2=Ic' \quad \text{[Math. 8]}$$

$$I1:I2=R4:(R2+R11) \quad \text{[Math. 9]}$$

Here, [Math. 9] can also be expressed as follows: I1=(I2×R4)/(R2+R11).

By deleting 12 from [Math. 8] and [Math. 9], I1 can be expressed using Ic', R2, R4, and R11.

Meanwhile, when denoting the voltage at contact position P2 as V2, the following mathematical expressions hold true.

$$V2=Vr-(Ic'\times R1+I1\times R2) \quad \text{[Math. 10]}$$

$$V2=I1\times R11 \quad \text{[Math. 11]}$$

By deleting V2 from [Math. 10] and [Math. 11] and substituting the mathematical expression indicating I1 acquired as described above from [Math. 8] and [Math. 9] for I1 in [Math. 10] and [Math. 11], the combined resistance R11 can be expressed only using the already known values Vr, Ic', R1, R2, R4.

Further, because 1/R11=(1/R3)+(1/R5) holds true, the thickness direction resistance R5 of the photoreceptor layer 222 can be calculated by using the following mathematical expression.

$$R5=R3\times R11/(R3-R11) \quad \text{[Math. 12]}$$

Figure 13:
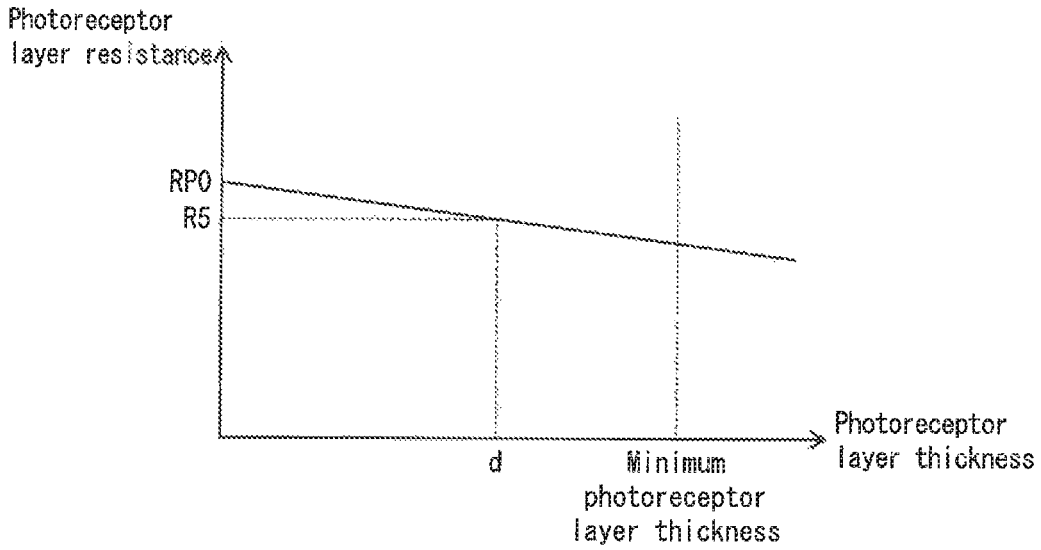
FIG. 13 illustrates a relationship between photoreceptor layer thickness and thickness direction resistance of the photoreceptor layer.

Typically, the smaller the photoreceptor layer thickness, the smaller the photoreceptor layer resistance, as schematically illustrated in FIG. 13. Thus, by storing in the ROM 54 in advance a function or a table indicating, for the photoreceptor layer material actually used, the relationship between photoreceptor layer thickness and resistance, photoreceptor layer thickness at a given point can be acquired by calculating photoreceptor layer resistance as described above.

2. In the embodiment, description is provided supposing that the change in resistance of the intermediate transfer belt 25, if any, is smaller enough than the change in resistance of the primary transfer roller 27 so that it can be ignored. However, in the long run, the resistance of the intermediate transfer belt 25 also tends to change, or more specifically, tends to decrease gradually with the application of the primary transfer bias to the primary transfer rollers 27 and the consequent breakdown of insulation of the material of the intermediate transfer belt 25. Thus, the acquisition of photoreceptor layer thickness can be performed with an even higher level of accuracy by also taking the change in resistance of the intermediate transfer belt 25 in consideration.

Figure 14:
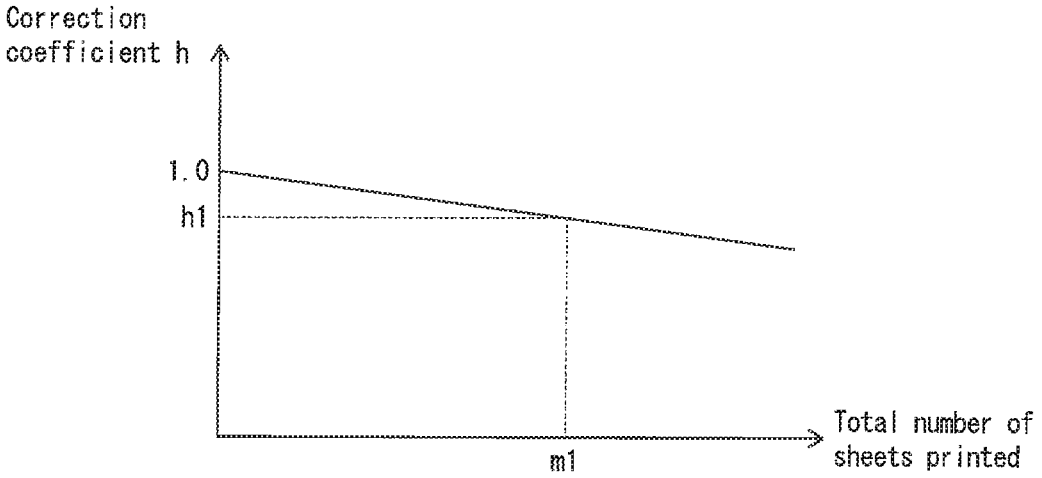
FIG. 14 illustrates a relationship between a total number of sheets printed and a correction coefficient applied to an intermediate transfer belt resistance that changes over time.
Figure 15:
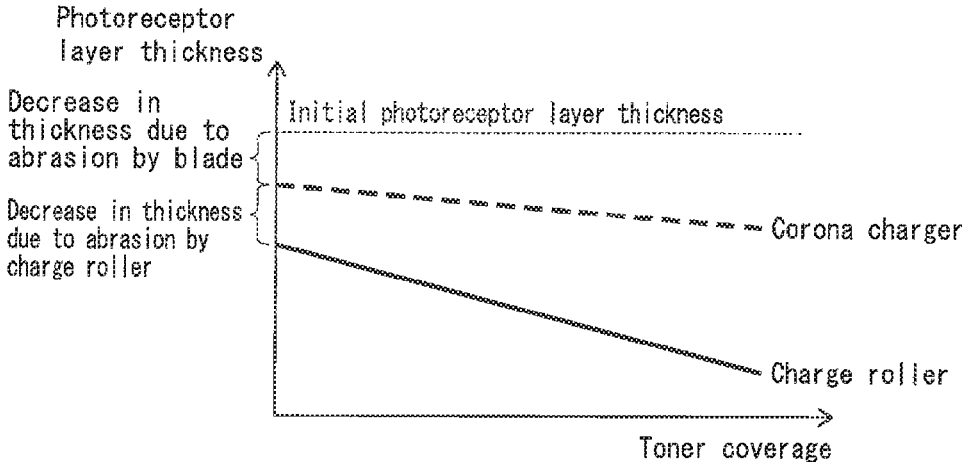
FIG. 15 shows a graph corresponding to when a corona charger is used as a photoreceptor drum charger and a graph corresponding to when a charge roller is used as a photoreceptor drum charger, and describes a difference between the two cases in terms of an amount of abrasion-caused decrease in photoreceptor layer thickness.

FIG. 14 shows a graph schematically illustrating the relationship between the total number of sheets printed and a correction coefficient h to be applied to the initial resistance Ru per unit length of the intermediate transfer belt 25. As illustrated in FIG. 14, the correction coefficient h is set to decrease from the initial value of 1.0 as the total number of sheets printed increases.

In this modification, the number of sheets printed is counted by an undepicted counter, and the total number of sheets printed is stored to the EEPROM 57.

Thus, the acquisition of photoreceptor layer thickness can be performed with an even higher level of accuracy by making a modification such that (i) a function or a table indicating the relationship between the total number of sheets printed and the correction coefficient h is stored in the ROM 54 in advance, and (ii) when the timing for performing the photoreceptor drum lifetime determination arrives (YES in Step S1 in FIG. 6), the CPU 51 performs the photoreceptor drum lifetime determination after acquiring a correction coefficient h1 corresponding to the total number of sheets printed (m1) at the present point based on the function (or the table) stored in the ROM 54, and multiplying the resistance R2, R3, and R4 between different contact positions of the intermediate transfer belt 25 by the acquired correction coefficient h1.

3. In the embodiment, the intermediate transfer belt 25 is moved away from the photoreceptor drums 22 (refer to Step S21 in FIG. 7, and FIG. 9) upon execution of the acquisition of correction coefficient. However, it can be expected that the detection of the voltage V0 (first voltage) of the primary transfer roller 27 in the acquisition of correction coefficient can be performed without trouble even if the intermediate transfer belt 25 is not moved away from the photoreceptor drums 22, by making a certain configuration. This configuration involves, for example, destaticizing the photoreceptor layer 222 of the photoreceptor drum 22 by causing the charge roller 241 to apply only an alternating voltage to the photoreceptor drum 22, (ii) providing a switching means that cuts off the connection between the elementary tube 221 and the ground, and (iii) controlling the switching means to cut off the connection between the elementary tube 221 and the ground and thereby put the photoreceptor drum 22 in electrically floating state.

4. The auxiliary primary transfer rollers 28C, 28M, 28Y, and 28K may each be replaced with an electrically conductive contact member that is made of an elongated material and that extends in parallel with the corresponding one among the primary transfer rollers 27C, 27M, 27Y, and 27K.

Further, the auxiliary primary transfer rollers 28C, 28M, 28Y, and 28K need not be provided with electrical conductivity and connected to the ground. In such a case, for each of the primary transfer rollers 27C, 27M, 27Y, and 27K, an electrically conductive contact member that is made of an elongated material, that extends in parallel with the primary transfer roller 27, and that is connected to the ground may be disposed upstream from the primary transfer roller 27.

5. In the embodiment, the constant current Ic (i.e., the first constant current) and the constant current Ic' (i.e., the second constant current) have different values. However, the first constant current and the second constant current may have the same value.

6. In the embodiment, description is provided based on a printer having the so-called tandem system. However, the present invention need not be applied to a printer with the tandem system, and may be applied to any image forming device having a photoreceptor and an intermediate transfer member, such as a facsimile device, a copier, or a monochrome image forming device.

Figure 16:
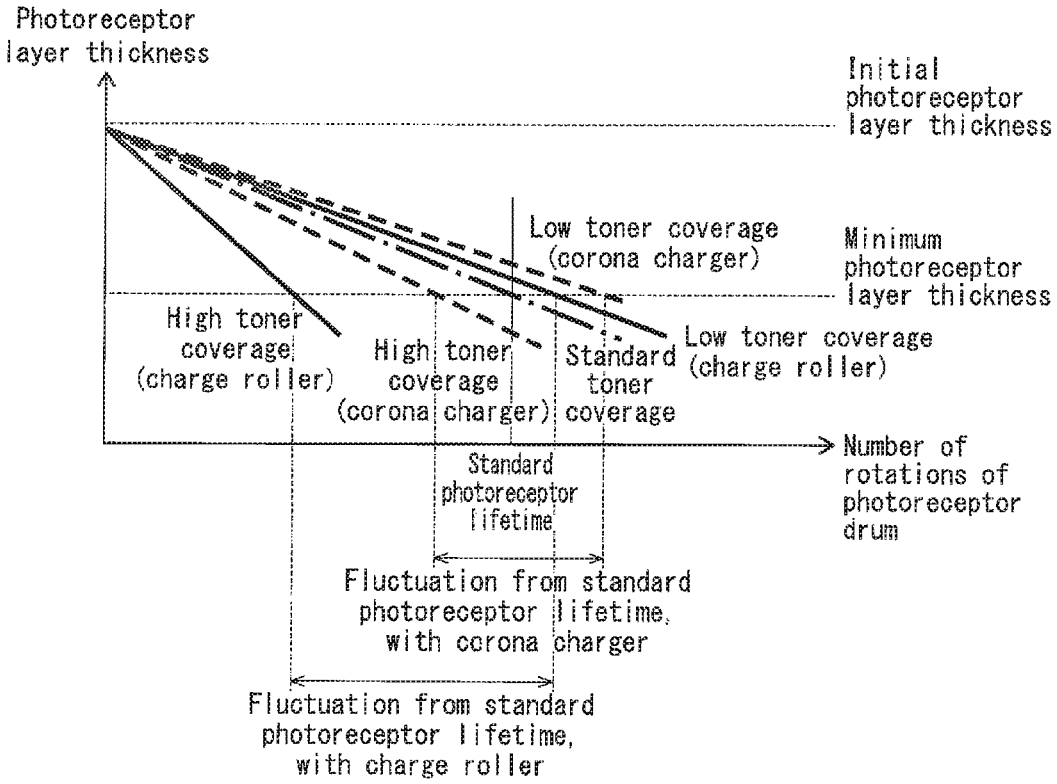
FIG. 16 shows a graph corresponding to when a corona charger is used as a photoreceptor drum charger and a graph corresponding to when a charge roller is used as a photoreceptor drum charger, and illustrates a fluctuation in photoreceptor drum lifetime occurring when toner coverage of printing is high and toner coverage of printing is low.

Further, in the embodiment, charging of a photoreceptor drum is achieved by using a charge roller. However, charging of a photoreceptor drum may be achieved by using a corona charger instead of a charge roller. This is because, as described above with reference to FIG. 16, a conventional method for determining photoreceptor drum lifetime gives rise to at least some fluctuation of actual photoreceptor drum lifetime from the standard photoreceptor drum lifetime even when a corona charger is used, and thus, application of the present invention enables the determination of photoreceptor drum lifetime to be performed with a higher level of accuracy.

7. The present invention encompasses any possible combination of the embodiment and the modifications.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming device comprising: a photoreceptor; a transfer member; and an intermediate transfer body, and forming an image by transferring a toner image formed by developing an electrostatic latent image formed on the photoreceptor from the photoreceptor to the intermediate transfer body by applying a transfer bias to the transfer member and putting the transfer member in contact with the intermediate transfer body, the image forming device comprising:

a constant current supplier selectively supplying a first constant current and a second constant current to the transfer member;

a first voltage acquirer acquiring a first voltage being a voltage occurring between the transfer member and the intermediate transfer body while the transfer member is being supplied with the first constant current;

a second voltage acquirer acquiring a second voltage being a voltage occurring between the transfer member and the photoreceptor while the transfer member is being supplied with the second constant current; and a photoreceptor thickness acquirer acquiring a value indicating a thickness of a photoreceptor layer of the photoreceptor by using the first voltage and the second voltage.

2. The image forming device of claim 1, wherein the first voltage acquirer acquires the first voltage with the intermediate transfer body not in contact with the photoreceptor.

3. The image forming device of claim 1 further comprising a conductive contact member abutting against the intermediate transfer body and connected to the ground, wherein the first voltage acquirer acquires, as the first voltage, a voltage occurring between the transfer member and the contact member while the transfer member is being supplied with the first constant current.

4. The image forming device of claim 3, wherein the contact member serves as a conductive auxiliary transfer member that is disposed upstream in a running direction of the intermediate transfer body than the photoreceptor and that presses the intermediate transfer body against the photoreceptor.

5. The image forming device of claim 1, wherein the second voltage acquirer acquires the second voltage with the intermediate transfer body in contact with the photoreceptor.

6. The image forming device of claim 5 further comprising a charger electrically charging the photoreceptor, wherein the second voltage acquirer acquires the second voltage with the photoreceptor electrically charged by the charger.

7. The image forming device of claim 6, wherein the charger electrically charges the photoreceptor with a charge roller.

8. The image forming device of claim 1 further comprising:

a display; and a display controller causing the display to display a message urging replacement of the photoreceptor only when the value indicating the thickness of the photoreceptor layer is equal to or smaller than a first threshold.

9. The image forming device of claim 8, wherein the display controller causes the display to display a message indicating that replacement of the photoreceptor is approaching only when the value indicating the thickness of the photoreceptor layer is greater than the first threshold and is equal to or smaller than a second threshold greater than the first threshold.

10. The image forming device of claim 1 further comprising a changer changing a condition to be applied in image forming depending upon the value indicating the thickness of the photoreceptor layer.

11. A method of acquiring a thickness of a photoreceptor layer of a photoreceptor in an image forming device comprising: the photoreceptor; a transfer member; and an intermediate transfer body, and forming an image by transferring a toner image formed by developing an electrostatic latent image formed on the photoreceptor from the photoreceptor to the intermediate transfer body by applying a transfer bias to the transfer member and putting the transfer member in contact with the intermediate transfer body, the method comprising:

supplying the transfer member with a first constant current and acquiring a first voltage being a voltage occurring between the transfer member and the intermediate transfer body while the transfer member is being supplied with the first constant current;

supplying the transfer member with a second constant current and acquiring a second voltage being a voltage occurring between the transfer member and the photoreceptor while the transfer member is being supplied with the second constant current; and acquiring a value indicating a thickness of the photoreceptor layer by using the first voltage and the second voltage.

* * * * *